US006895203B2

(12) United States Patent
Ozeki et al.

(10) Patent No.: US 6,895,203 B2
(45) Date of Patent: May 17, 2005

(54) DEVELOPING METHOD AND APPARATUS USING TWO-INGREDIENT DEVELOPER WITH PRESCRIBED COATING OF PARTICLES AND RESIN

(75) Inventors: Takamasa Ozeki, Kanagawa (JP); Akira Azami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/355,119

(22) Filed: Jan. 31, 2003

(65) Prior Publication Data

US 2003/0161665 A1 Aug. 28, 2003

(30) Foreign Application Priority Data

| | | |
|---|---|---|
| Feb. 1, 2002 | (JP) | 2002-025172 |
| Feb. 12, 2002 | (JP) | 2002-033709 |
| Feb. 12, 2002 | (JP) | 2002-033718 |
| Apr. 30, 2002 | (JP) | 2002-128705 |

(51) Int. Cl.[7] ..... G03G 15/09
(52) U.S. Cl. ..... 399/267; 399/274
(58) Field of Search ..... 399/267, 274, 399/275, 276, 277; 430/111.1, 111.35, 122

(56) References Cited

U.S. PATENT DOCUMENTS

| | | | | |
|---|---|---|---|---|
| 4,696,255 | A * | 9/1987 | Yano et al. | |
| 5,321,473 | A | 6/1994 | Azami | |
| 5,991,586 | A * | 11/1999 | Nagao | 399/274 |
| 6,406,826 | B1 * | 6/2002 | Suzuki et al. | 430/111.35 |
| 2002/0028094 | A1 * | 3/2002 | Sakemi et al. | 399/276 |

FOREIGN PATENT DOCUMENTS

| | | | |
|---|---|---|---|
| JP | 5-19632 | 1/1993 | |
| JP | 566661 | 3/1993 | |
| JP | 9-22188 | 1/1997 | |
| JP | 9-160304 A * | 6/1997 | |
| JP | 11-327305 | 11/1999 | |
| JP | 2000-10336 | 1/2000 | |
| JP | 2000-47489 | 2/2000 | |
| JP | 2000-155462 | 6/2000 | |
| JP | 2000-250308 | 9/2000 | |
| JP | 2001-5293 | 1/2001 | |
| JP | 2001-51454 A * | 2/2001 | |
| JP | 2001-188388 | 7/2001 | |
| JP | 2001188388 A * | 7/2001 | ..... G03G/9/113 |
| JP | 2002-62737 | 2/2002 | |

OTHER PUBLICATIONS

Patent Abstracts of Japan, JP 2001–188388, Jul. 10, 2001.

* cited by examiner

*Primary Examiner*—Arthur T. Grimley
*Assistant Examiner*—Ryan Gleitz
(74) *Attorney, Agent, or Firm*—Oblon, Spivak, McClelland, Maier & Neustadt, P.C.

(57) ABSTRACT

A developing method of the present invention is practicable with a developing unit of the type including a rotatable, nonmagnetic sleeve and a rigid metering member. A two ingredient type developer made up of magnetic carrier grains and toner grains is magnetically deposited on the sleeve. The metering member meters the amount of the developer deposited on the sleeve. The sleeve has surface roughness Rz ranging from 5 $\mu$m to 20 $\mu$m. The carrier grains each are covered with a coating layer containing at least binder resin and grains. The ratio of the diameter D of the individual grain contained in the coating layer to the thickness h of the binder resin layer lies in the range of $1<D/h<10$. The carrier grains have a weight-mean grain size ranging from 20 $\mu$m to 60 $\mu$m.

13 Claims, 24 Drawing Sheets

FIG. 3

| GRAIN SIZE (μm) | EX. 1 | COM. EX. 1 |
|---|---|---|
| 65 | ◎ | ○ |
| 60 | ◎ | △ |
| 40 | ○ | △ |
| 20 | ○ | × |
| 18 | △ | × |

| RATIO OF DECREASE |
|---|
| ◎ 0～10%<br>○ 10～30%<br>△ 30～40%<br>× 40%～ |

FIG. 4

| | GRAINS IN COATING | | | | RESIN THICKNESS h(μm) | D/h | RATIO OF DECREASE |
|---|---|---|---|---|---|---|---|
| | MATERIAL | GRAIN SIZE (μm) | RESISTIVITY (Ω·cm) | CONTENT (wt%) | | | |
| EX. 1 | ALUMINA | 0.3 | $10^{14}$ | 80 | 0.15 | 2.0 | ○ |
| EX. 2 | ALUMINA | 0.3 | $10^{14}$ | 80 | 0.08 | 3.8 | ○ |
| EX. 3 | ALUMINA | 0.3 | $10^{14}$ | 80 | 0.03 | 9.7 | ○ |
| EX. 4 | ALUMINA | 0.2 | $10^{13}$ | 80 | 0.10 | 2.0 | ○ |
| COM. EX. 1 | TITANIUM OXIDE | 0.02 | $10^{7}$ | 40 | 0.15 | 0.13 | × |

FIG. 5

| GRAIN SIZE D(μm) | SURFACE ROUGHNESS Rz(μm) | D/Rz | RATIO OF DECREASE | PEELING | CARRIER SPENT |
|---|---|---|---|---|---|
| 80 | 4 | 20 | △ | ◎ | ◎ |
| 40 | 4 | 10 | △ | ◎ | ◎ |
| 70 | 12 | 5.8 | △ | ○ | ○ |
| 60 | 12 | 5.0 | ○ | ○ | ○ |
| 22 | 5 | 4.4 | ○ | ○ | ○ |
| 36 | 12 | 3.0 | ◎ | ○ | ○ |
| 14 | 5 | 2.8 | △ | △ | ○ |
| 40 | 20 | 2.0 | ◎ | × | △ |
| 40 | 30 | 1.3 | ◎ | × | △ |

| PEELING & CARRIER SPENT | |
|---|---|
| ◎ | EXCELLENT |
| ○ | GOOD |
| △ | POOR |
| × | NO GOOD |

FIG. 6

| SHIFT TORQUE (kgf·cm) | EX. 1 | | COM. EX. 1 | |
|---|---|---|---|---|
| | RATIO OF DECREASE | CHARGING | RATIO OF DECREASE | CHARGING |
| 0.4 | ○ | × | ○ | × |
| 0.5 | ○ | ○ | △ | ○ |
| 1.0 | ◎ | ◎ | △ | ◎ |
| 2.0 | ◎ | ◎ | △ | ○ |
| 4.0 | ○ | ○ | × | × |
| 4.5 | × | △ | × | × |

FIG. 7

| DIAMETER (mm) | EX. 1 | COM. EX. 1 |
|---|---|---|
| 12 | × | × |
| 15 | ○ | × |
| 25 | ○ | △ |
| 35 | ○ | △ |
| 40 | ◎ | ○ |

FIG. 8

| LINEAR VELOCITY (mm/sec) | EX. 1 | COM. EX. 1 |
|---|---|---|
| 130 | ◎ | ○ |
| 150 | ◎ | △ |
| 300 | ○ | △ |
| 500 | ○ | × |
| 700 | ○ | × |
| 750 | △ | × |

FIG. 9

| GAP Gp (mm) | GRANULARITY |
|---|---|
| 0.4 | 0.45 |
| 0.5 | 0.53 |
| 0.6 | 0.61 |

FIG. 13

| GRAIN SIZE $\alpha$ ($\mu$m) | GRANULARITY |
|---|---|
| 35 | 0.27 |
| 60 | 0.45 |
| 80 | 0.62 |

FIG. 14

| GRAIN SIZE (μm) | EX. 1 | COM. EX. 1 |
|---|---|---|
| 65 | ◎ | ○ |
| 60 | ◎ | △ |
| 40 | ○ | △ |
| 20 | ○ | × |
| 18 | △ | × |

| DECREASE OF DEPOSITION |
|---|
| ◎ EXCELLENT |
| ○ GOOD |
| △ POOR |
| × NO GOOD |

FIG. 16

| SHAFT TORQUE (kgf·cm) | EX. | | COM. EX. | |
|---|---|---|---|---|
| | TONER SPENT | CHARGING | TONER SPENT | CHARGING |
| 0.4 | ○ | × | ○ | × |
| 0.5 | ○ | ○ | △ | ○ |
| 1.0 | ◎ | ◎ | △ | ◎ |
| 2.0 | ◎ | ◎ | △ | ○ |
| 4.0 | ○ | ○ | × | × |
| 4.5 | × | △ | × | × |

| TONER SPENT | | CHARGING |
|---|---|---|
| ESTIMATION | TRANSMITTANCE (%) | ESTIMATION |
| ◎ EXCELLENT | 90～ | ◎ EXCELLENT |
| ○ GOOD | 80～90 | ○ GOOD |
| △ POOR | 60～80 | △ POOR |
| × NO GOOD | ～60 | × NO GOOD |

FIG. 18

| SHAFT TORQUE (kgf·cm) | DOCTOR | POLE FLUX DENSITY FACING DOCTOR (mT) | TONER | SPENT ESTIMATION | |
|---|---|---|---|---|---|
| | | | | EX. | COM. EX. |
| 0.4 | MAGNETIC | 40 | WITHOUT WAX | ◎ | ○ |
| 0.4 | MAGNETIC | 45 | WITHOUT WAX | ◎ | △ |
| 1.0 | MAGNETIC | 55 | WITHOUT WAX | ◎ | △ |
| 2.0 | MAGNETIC | 60 | WITHOUT WAX | ◎ | △ |
| 4.0 | MAGNETIC | 75 | WITHOUT WAX | ○ | × |
| 4.5 | MAGNETIC | 80 | WITHOUT WAX | △ | × |
| 3.0 | NON MAGNETIC | 75 | WITHOUT WAX | ◎ | △ |
| 1.0 | MAGNETIC | 55 | WITH WAX | ○ | × |

FIG.21

| | P1(mT) | P2(mT) |
|---|---|---|
| COM. EX. | 110 | 75 |
| EX. | 120 | 85 |

FIG.24

| LogR(Ω・cm) | DC | AC |
|---|---|---|
| 16 | ○ | ○ |
| 15 | ○ | × |
| 14 | ○ | × |

○: NO LEAK
×: LEAK

FIG.25

| | EX. | COM. EX. |
|---|---|---|
| P1(mT) | 120 | 110 |
| P2(mT) | 85 | 75 |
| LogR(Ω・cm) | 15 | 16 |
| Gp(mm) | 0.4 | 0.5 |

DEVELOPING METHOD AND APPARATUS USING TWO-INGREDIENT DEVELOPER WITH PRESCRIBED COATING OF PARTICLES AND RESIN

BACKGROUND OF THE INVENTION

1. Field of the Invention

The present invention relates to a copier, facsimile apparatus, printer or similar image forming apparatus and more particularly to a developing method using a two-ingredient type developer and an image forming apparatus using the same.

2. Description of the Background Art

Generally, an electrophotographic or similar image forming apparatus include either one of two different types of developing devices, i.e., one using a two-ingredient type developer consisting of toner and magnetic carrier and the other using a one-ingredient type developer, i.e., toner. A developing device using a two-ingredient type developer usually includes a rotatable sleeve or developer carrier accommodating a magnetic roller provided with a plurality of magnetic poles. Magnetic carrier grains on which toner grains are deposited are magnetically caused to deposit on the sleeve and conveyed by the sleeve to a developing position where the sleeve faces an image carrier. At the developing position, the developer, forming a magnet brush, develops a latent image formed on the image carrier for thereby producing a corresponding toner image.

The carrier grains and toner grains constituting the two-ingredient type developer are charged by being agitated together, so that the toner grains are stably charged and form a relatively stable toner image. However, a problem with this type of developer is that the carrier grains deteriorate due to repeated development while the toner content of the developer and therefore the toner and carrier mixture ratio varies due to consumption. To cope with the variation of the toner and carrier mixture ratio, it is necessary to replenish fresh toner grains to the developer by using a toner content control device.

A developing device using the one-ingredient type developer or toner causes the sleeve to convey only the toner deposited thereon to the developing position and is therefore free from the problems stated above. However, this kind of developer cannot be stably charged. Further, a force that retains the toner on the sleeve is generally weak, and the toner cannot be conveyed in a desirable condition. In light of this, Japanese Patent Publication No. 64-12386, for example, proposes to increase the surface roughness of the sleeve for thereby enhancing the conveyance of the toner and therefore image quality.

The magnetic carrier grains must be protected from the filming of the toner grains thereon, be provided with a uniform surface configuration, be protected from oxidation and decrease in sensitivity to humidity, and be prevented from scratching or wearing the image carrier. Further, the carrier grains must be configured to extend the life of the developer and to control chargeability and adjust the amount of charge. To meet these requirements, it is a common practice to coat the carrier grains with, e.g., suitable resin to thereby form rigid, strong coating layers.

For example, Japanese Patent Laid-Open Publication No. 58-108548 discloses magnetic carrier grains coated with particular resin. Japanese Patent Laid-Open Publication Nos. 54-155048, 57-40267, 58-108549 and 59-166968, Japanese Patent Publication Nos. 1-19584 and 3-628 and Japanese Patent Laid-Open Publication No. 6-202381 each teach magnetic carrier grains with various additives added to coating layers. Japanese Patent Laid-Open Publication No. 5-273789 proposes magnetic carrier grains with an additive deposited on their surfaces. Japanese Patent Laid-Open Publication No. 9-160304, teaches magnetic carrier grains each being covered with a coating layer containing conductive grains greater in size than the coating film. Japanese Patent Laid-Open Publication No. 8-6307 proposes to use a benzoguanamine-n-butylalcohol-formaldehyde copolymer as the major component of a carrier coating material.

Further, Japanese Patent Laid-Open Publication No. 2001-188388 discloses carrier grains covered with coating layers, which contain at least binder resin and grains each, and characterized in that the grain size D of the grains contained in the coating layers and the thickness h of the binder resin layer lie in the range of $1<D/h<5$. In this condition, the grains of the coating layers protrude from the coating layers and can absorb, when the developer is charged by agitation, impactive contact occurring on the binder resin due to friction between the carrier grains and toner grains or between the carrier grains. This successfully prevents the toner grains from being spent on the carrier grains and prevents the binder resin where charge is expected to be generated from being shaved off, thereby causing the surface configuration of the carrier grains to vary little despite aging. In addition, the durability of the carrier grains is enhanced.

Hereinafter will be described problems. (1) through (3) of the conventional technologies to which the present invention addresses.

(1) A current trend with the developing device of the type using the two-ingredient type developer is toward a small carrier grain size for reducing brush marks and granularity and thereby enhancing image quality. However, the fluidity of the carrier tends to decrease with a decrease in carrier grain size, making it difficult for the developer to be deposited on the sleeve. Consequently, the amount of the developer deposited on the sleeve, i.e., conveyed by the sleeve via a doctor or metering member for a unit area tends to decrease or the deposition of carrier grains on the image carrier is likely occur. Particularly, the amount of deposition of the developer on the sleeve decreases with the elapse of time due to the wear of the sleeve, the deterioration of the developer, and the variation of frictional resistance ascribable to toner filming on the sleeve. Consequently, a decrease in carrier grain size results in a decrease in the amount of deposition of the developer on the sleeve that adversely effects image quality, making the amount of the developer to reach the developing position short.

(2) In the developing device of the type using the two-ingredient type developer, assume that the gap between the sleeve and the image carrier is reduced to enhance the developing ability and therefore image quality, which includes stable image density and reproducibility, as stated earlier. Then, the distance between the sleeve and the carrier grains present on the tips of brush chains, which form a magnet brush, is reduced, so that a magnetic force acting on the carrier grains is intensified to thereby cause a minimum of carrier grains to deposit on the image carrier. Reducing the gap for development is therefore effective to enhance image quality.

Now, to allow the two-ingredient type developer to be conveyed to the developing position in an adequate amount, the amount of the developer to deposit on the sleeve is controlled in accordance with the gap for development. More specifically, the lower limit of the amount of deposition is selected such that brush marks do not appear in an image. Also, the upper limit of the amount of deposition is selected such that the overflow of the developer, the locking of the sleeve, the adhesion of the developer to the sleeve and other troubles ascribable to the packing of the developer in the above gap do not occur. It is to be noted that because the packing mentioned above is more likely to occur as the gap becomes greater, it is necessary to lower the upper limit of the amount of deposition. More specifically, the smaller the gap, the narrower the adequate range of the amount of deposition available.

On the other hand, the amount of deposition of the developer on the sleeve involves irregularity due to the tolerance of a so-called doctor gap between the doctor and the sleeve, which is, in turn, ascribable to the dimensional accuracy or the mounting accuracy of the doctor or that of the sleeve. Also, as for aging, the amount of deposition tends to decrease due to, e.g., the wear of the surface of the sleeve, the deterioration of the developer, and the variation of frictional resistance ascribable to toner filming on the sleeve. Further, when the gap for development is reduced, the doctor gap should also be reduced in order to reduce the amount of deposition. This, however, makes stress exerted by the doctor on the developer heavy and is apt to accelerate the deterioration of the developer, further reducing the amount of deposition. Therefore, the prerequisite with the developing device with a narrow gap for development is that the deterioration of the developer ascribable to aging and therefore the variation of the amount of deposition be reduced.

(3) In the developing device using the two-ingredient type developer, high-quality images free from background contamination and toner scattering are achievable if the developer containing adequately charged toner grains is conveyed to the developing position so as to develop a latent image formed on the image carrier with the toner grains. To charge the toner grains to an adequate charge value, it is necessary to stably charge the toner and therefore to increase the shaft torque of the sleeve to a certain degree. However, an increase in the shaft torque of the sleeve directly translates into heavy stress to act on the developer, aggravating the toner spent condition on the carrier. This makes it difficult to adequately charge the toner grains despite aging and therefore adversely effects the resulting image. Particularly, when a document with a high image area ratio, i.e., a solid image is copied in a repeat copy mode, toner charging is not fast enough to meet the need with the result that the influence of the toner spent condition appears as a critical image defect.

The developer may be stably conveyed to the developing position if much developer is held at a position downstream of the doctor. For this purpose, the doctor may be formed of a magnetic material or the flux density of the pole of a magnet roller facing the doctor may be increased. This kind of scheme, however, makes the stress acting on the developer excessively heavy, further aggravating the toner spent condition.

Further, in parallel with the trend toward oil-less fixation, wax-containing toner is replacing the conventional fixing oil. However, the problem with wax-containing toner is that wax leaks from the toner and aggravates the toner spent condition.

(4) The smaller carrier grain size meeting the need for higher image quality, as stated earlier, brings about a problem that magnetization is reduced to such a degree that the carrier grains deposit on the image carrier. Also, to meet the increasing demand for a small-size image forming apparatus, the diameter of a photoconductive drum, which is a specific form of the image carrier, and that of the sleeve are decreasing. However, a decrease in the diameter of the drum or that of the sleeve causes magnetic restraint acting on the carrier grains, which are present on the tips of the brush chains downstream of the developing position, to decrease, aggravating the carrier deposition on the drum. As a result, the drum, a cleaning blade and an intermediate image transfer body are more rapidly deteriorated while an image is locally omitted due to the carrier grains deposited on the drum.

To reduce the carrier deposition on the drum, the magnetic force of, among the poles of the magnet roller disposed in the sleeve, a main pole facing the drum and that of a pole downstream of the main pole may be intensified. This kind of-scheme increases magnetic restraint on the carrier grains being conveyed away from the main pole toward the downstream pole to thereby obstruct the separation of the carrier grains from the magnet brush.

Alternatively, the resistance of the carrier grains may be lowered to allow counter charge left on the carrier grains after the development of a solid image to be easily dissipated, thereby reducing the deposition of the carrier grains on the edge portions of an image ascribable to the counter charge. However, a decrease in the resistance of the carrier grains is likely to cause the charge to easily leak, so that defective images occur when use is made of an AC bias for development.

Further, the gap for development may be reduced for the same purpose. This, however, brings about the problems stated earlier. More specifically, although the initial amount of deposition of the developer on the sleeve may be made relatively great in consideration of a decrease to occur due to the deterioration of the developer and that of the sleeve surface, this further intensifies the packing in the developing position due to the variation of the amount of deposition.

None of the schemes described above can reduce the carrier deposition on the drum to the allowable level alone in the condition wherein the carrier grain size or the diameter of the drum or that of the sleeve is reduced.

Technologies relating to the present invention are also disclosed in, e.g., Japanese patent Laid-Open Publication Nos. 5-19632, 5-66661, 11-327305, 2000-10336, 2000-47489, 2000-155462, 2000-250308, 2001-5293, 2001-188388 and 2002-62737.

SUMMARY OF THE INVENTION

It is an object of the present invention to provide a developing method capable of stably conveying a two-ingredient type developer to a developing position by controlling the variation of the amount of deposition of the developer and thereby insuring high image quality over a long term, and an image forming apparatus using the same.

It is another object of the present invention to provide a developing method capable of conveying a two-ingredient type developer with a stable amount of charge to a developing position over a long term by controlling the toner spent condition on carrier grains and thereby insuring high-quality images free from background contamination, toner scattering and other defects, and an image forming apparatus using the same.

It is a further object of the present invention to provide a developing method capable of controlling the carrier deposition on an image carrier despite the use of carrier grains with a small grain size and an image carrier and a developer carrier having a small diameter each, and an image forming apparatus using the same.

An image forming apparatus of the present invention includes a developing unit configured to develop latent image formed on an image carrier with a developer carrier. The developer carrier is made up of a rotatable, nonmagnetic sleeve and a magnetic field generating member disposed in the sleeve for causing a two-ingredient type developer, which consists of magnetic carrier grains and toner grains, to deposit on the surface of the developer carrier. A rigid metering member meters the amount of the developer deposited on the developer carrier. The sleeve has surface roughness Rz ranging from 5 $\mu$m to 20 $\mu$m. The carrier grains each are covered with a coating layer containing at least binder resin and grains. The ratio of the diameter D of the individual grain contained in the coating layer to the thickness h of the binder resin layer lies in a range of $1<D/h<10$. The carrier grains have a weight-mean grain size d ranging from 20 $\mu$m to 60 $\mu$m.

BRIEF DESCRIPTION OF THE DRAWINGS

The above and other objects, features and advantages of the present invention will become more apparent from the following detailed description taken with the accompanying drawings in which:

FIG. 3 is a table listing the results of Experiment 2 relating to the first embodiment;

FIG. 4 is a table listing the results of Experiment 3 relating to the first embodiment;

FIG. 5 is a table listing the results of Experiment 4 relating to the first embodiment;

FIG. 6 is a table listing the results of Experiment 5 relating to the first embodiment;

FIG. 7 is a table listing the results of Experiment 6 relating to the first embodiment;

FIG. 8 is a table listing the results of Experiment 7 relating to the first embodiment;

FIG. 9 is a table listing the results of Experiment 1 relating to the second embodiment;

FIG. 13 is a table listing the results of Experiment 3 relating to the second embodiment;

FIG. 14 is a table listing the results of Experiments 4 relating to the second embodiment;

FIG. 16 is a table listing the results of Experiment 2 relating to the third embodiment;

FIG. 18 is a table listing the results of Experiment 3 relating to the third embodiment;

FIG. 21 is a table listing the results of Experiment 3 relating to the fourth embodiment;

FIG. 24 is a table listing the results of Experiment 5 relating to the fourth embodiment;

FIG. 25 is a table listing particular conditions selected in consideration of the results of Experiments 1 through 5 relating to the fourth embodiment.

DESCRIPTION OF THE PREFERRED EMBODIMENTS

Preferred embodiments of the developing method and image forming apparatus using the same in accordance with the present invention will be described hereinafter.

First Embodiment

A first embodiment of the present invention mainly addresses to the problem (1) of the conventional technologies stated earlier. The illustrative embodiment is applied to an image forming apparatus of the type including a photoconductive drum or image carrier and a charger, an exposing unit, a developing unit, an image transferring unit and a cleaning unit sequentially arranged around the drum. The image forming apparatus additionally includes a sheet feeding device for feeding a sheet or recording medium from a sheet tray, and a fixing unit for fixing a toner image transferred to the sheet after the sheet has been separated from the drum.

In operation, while the drum is in rotation, the charger uniformly charges the surface of the drum. The exposing unit scans the charged surface of the drum with, e.g., a laser beam in accordance with image data to thereby form a latent image. The developing unit deposits charged toner on the latent image for thereby producing a corresponding toner image. When a sheet fed from the sheet tray reaches an image transfer position between the drum and the image transferring unit, the image transfer unit transfers the toner image from the drum to the sheet by applying a charge opposite in polarity to the toner image to the sheet. The sheet is then separated from the drum and conveyed to the fixing unit and has its toner image fixed thereby.

Figure 1:
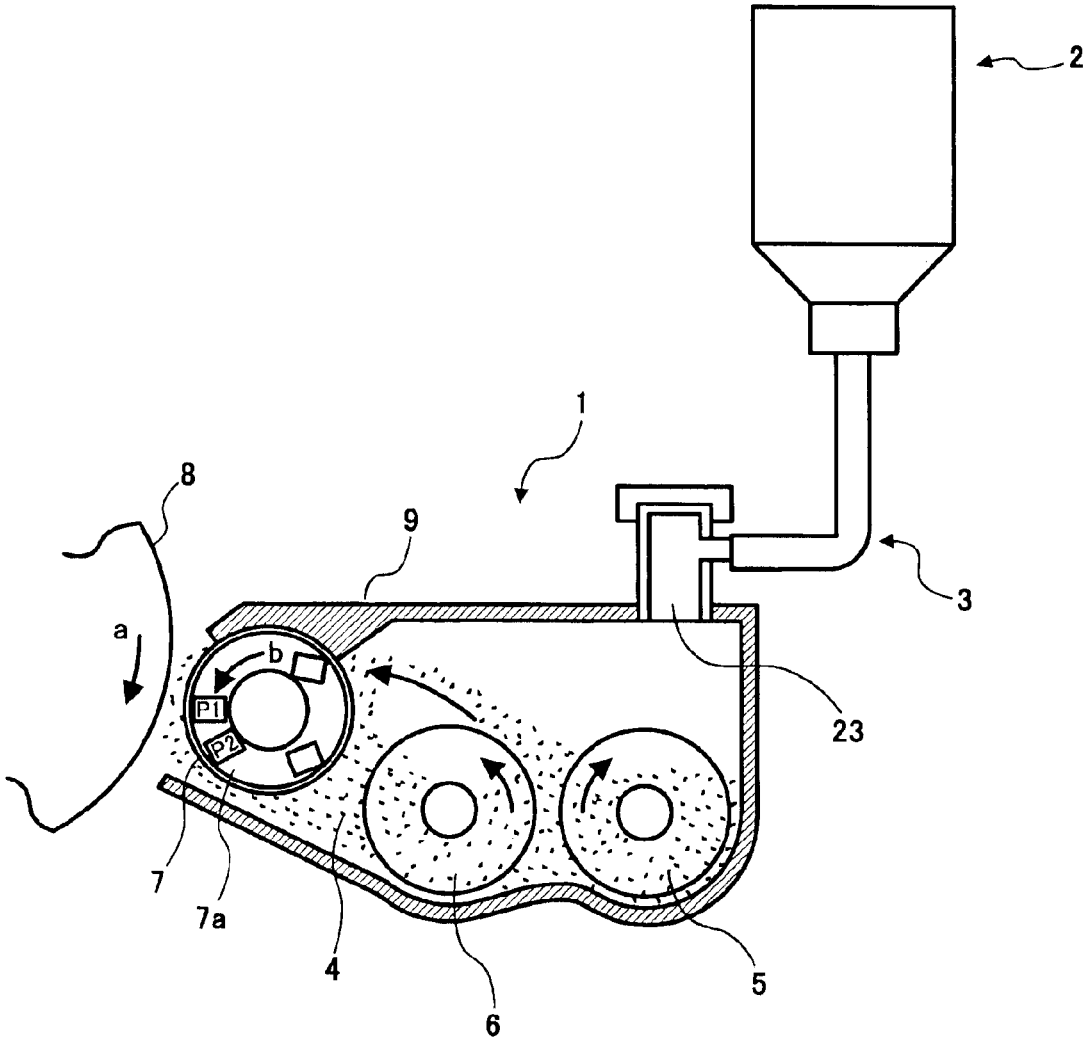
FIG. 1 is a view showing a developing unit included in an image forming apparatus with which a first to a fourth embodiments of the present invention are practicable.

Referring to FIG. 1 of the drawings, the developing unit included in the illustrative embodiment is shown and generally designated by the reference numeral 1. As shown, the developing device 1 is positioned at one side of a photoconductive drum 8 and includes a nonmagnetic sleeve or developer carrier 7. A two-ingredient type developer consisting of toner grains and magnetic carrier grains is deposited on the sleeve 7. The sleeve 7 is partly exposed to the outside through an opening formed in part of the casing of the developing unit 1 that faces the drum 1. A drive source, not shown, causes the sleeve 7 to rotate in a direction indicated by an arrow b in FIG. 1. A stationary magnet roller or magnetic field forming means 7*a* is disposed in the sleeve 7 and provided with a plurality of magnets.

In the developing device 1, a doctor or metering member 9 is formed of a rigid material and regulates the amount of the developer deposited on the sleeve 7. A developer storing portion 4 is positioned upstream of the doctor 9 in the direction of rotation of the sleeve 7 and stores the developer. A first and a second screw or agitator 5 and 6 convey the developer while agitating it. Positioned above the developer storing portion 4 are a port 23 for replenishment, a toner hopper 2 storing fresh toner to be replenished to the developer storing portion 4 via the port 23, and a passage 3 providing fluid communication between the port 23 and the toner hopper 2.

The first and second screws 5 and 6 in rotation agitate the developer present in the developer storing portion 4 for thereby charging the toner grains and magnetic carrier grains to opposite polarities. The charged developer is conveyed toward the sleeve 7, which is in rotation, and deposited on the surface of the sleeve 7. The sleeve 7 conveys the developer in the direction b toward a developing position where the drum 8 and sleeve 7 face each other. At this instant, the doctor 9 causes the developer to form a thin layer on the sleeve 7. At the developing position, the toner grains contained in the developer are electrostatically transferred from the sleeve 7 to a latent image formed on the drum 8, thereby producing a corresponding toner image.

In the illustrative embodiment, the sleeve 7 is provided with surface roughness Rz of 5 $\mu$m to 20 $\mu$m, preferably 5 $\mu$m to 15 $\mu$m. Surface roughness below 5 $\mu$m fails to sufficiently improve frictional resistance between the developer and the sleeve 7, making the amount of the developer to deposition the sleeve 7 short. On the other hand, surface roughness above 20 $\mu$m is apt to cause the carrier grains to crack or cause coating resin to come off even when the magnetic carrier grains are resistant to stress.

To confine the surface roughness Rz in the above range, the surface of the sleeve 7 may be subjected to, e.g., sand blasting, grinding, grooving, sand-paper processing or index-saver processing. Sand blasting, among others, is expected to evenly improve frictional resistance between the developer and the sleeve 7 in all directions because it is easy and efficient to perform and can randomly roughen a desired surface. Sand blasting can therefore cause the developer to uniformly deposit on the sleeve 7 for thereby insuring high image quality free from irregular density. Surface roughness Rz refers to ten-point mean surface roughness and was measured by Surfcoder SE-30H available from Kosaka Laboratory Ltd. Ten-point mean surface roughness well reflects the depth of fine recesses formed in the surface of a solid body.

The sleeve 7 may be formed of any one of materials customarily applied to a developing device. For example, use may be made of stainless steel, aluminum, ceramics or similar nonmagnetic material with or without coating provided thereon. Also, the configuration of the sleeve 7 is open to choice.

In the illustrative embodiment, the doctor 9 is formed of a magnetic material, e.g., iron, stainless steel or similar metal or resin containing fine grains of ferrite, magnetite or similar magnetic material. If desired, a separate plate, for example, formed of such a magnetic material may be directly or indirectly affixed to the doctor 9.

In the illustrative embodiment, the magnetic carrier grains have a weight-mean grain size d of 20 $\mu$m to 60 $\mu$m, and each has a coating layer including at least binder resin and grains having. In the illustrative embodiment, the ratio of the diameter D of the grains contained in the coating layer to the thickness h of the binder resin layer lies in a range of $1<D/h<10$, preferably $1<D/h<5$. If the ratio D/h is smaller than 1, then the grains are buried in the binder resin and cannot exhibit the expected effect. If the ratio D/h is greater than 10, then the area over which the grains and binder resin contact each other is so small, that the grains easily part from the binder resin.

As for the core of the carrier, ferrite, magnetite, iron, nickel or similar material customary with a two-ingredient type developer may be used in accordance with the application of the carrier. The grains contained in the coating layer may be formed of alumina or silica by way of example. Alumina grains should preferably have a grain size of 10 $\mu$m or below and may be or may not be subjected to surface treatment for, e.g., hydrophobicity. Silica grains may be or may not be those used for toner and may or may not be subjected to surface treatment for, e.g., hydrophobicity.

Further, carbon black or an acid catalyst may be used as a charge and resistance control agent either singly or in combination. Carbon black may be of any kind generally applied to carrier grains or toner grains. The oxide catalyst may have a reaction radical of, e.g., perfect alkylated radical type, methylol radical type, imino radical type or methylol/imino radical type. As for the binder resin of the coating layer, use may be made of any binder resin customary with the coating layer of magnetic carrier for a two-ingredient type developer, e.g., acrylic resin.

Japanese Patent Laid-Open Publication No. 9-160304 discloses magnetic carrier grains similar to the carrier grains of the illustrative embodiment in that a coating layer contains conductive grains whose grain size is greater than the thickness of the coating resin layer. The illustrative embodiment differs from this prior art configuration as to the resistance of grains contained in a coating layer. More specifically, in the prior art configuration, the grains form a conduction path so as not to increase the resistance of the carrier. By contrast, in the illustrative embodiment, the grains do not adjust resistance, but protects the coating layer resin and adjusts the surface configuration.

Examples of the magnetic carrier of the illustrative embodiment and comparative examples (conventional magnetic carriers with small grain sizes) will be described hereinafter.

EXAMPLE 1

56.0 parts of acrylic resin solution (50 wt % of solid), 15.6 parts of guanamine solution, 160.0 parts of alumina grains (0.3 $\mu$m; resistivity of $10^{14}$ $\Omega\cdot$cm), 900 parts of toluene and 900 parts of butyl cellosolve were dispersed in a homomixer for 10 minutes to thereby prepare a film forming solution. The film forming solution was coated on cores, which were implemented by sintered ferrite F-300 available from Powdertech (mean grain size of 50 $\mu$m), by Spilacoater available from Okada Seikosha to thickness of 0.15 $\mu$m and then dried. The resulting carrier grains were left in an electric furnace at 150° C. for 1 hour and then cooled off. The resulting ferrite powder bulk was classified by a 100 μm sieve to thereby produce carrier grains. The ratio of the grain size D (0.3 m) of the alumina grains contained in the coating layer to the thickness h (0.15 μm) of the binder resin layer, i.e., D/h is 2.0.

As for the thickness of the binder resin layer, by observing the section of the individual carrier grain with a transmission electron microscope, it is possible to see the coating layer covering the surface of the carrier grain. Therefore, the above thickness is represented by the mean thickness of the coating layers of the carrier grains.

COMPARATIVE EXAMPLE 1

56.0 parts of acrylic resin solution (50 wt % of solid), 15.6 parts of guanamine solution (77 wt % of solid), 900 parts of toluene and 900 parts of butyl cellosolve were dispersed in a homomixer for 10 minutes to thereby prepare a film forming solution. The film forming solution was coated on cores, which were also implemented by the sintered ferrite F-300, by Spilacoater to thickness of 0.15 μm and then dried. The resulting carrier grains were left in an electric furnace at 150° C. for 1 hour and then cooled off. The resulting ferrite powder bulk was classified by a 100 μm sieve to thereby produce carrier grains.

EXPERIMENT 1

Figure 2:
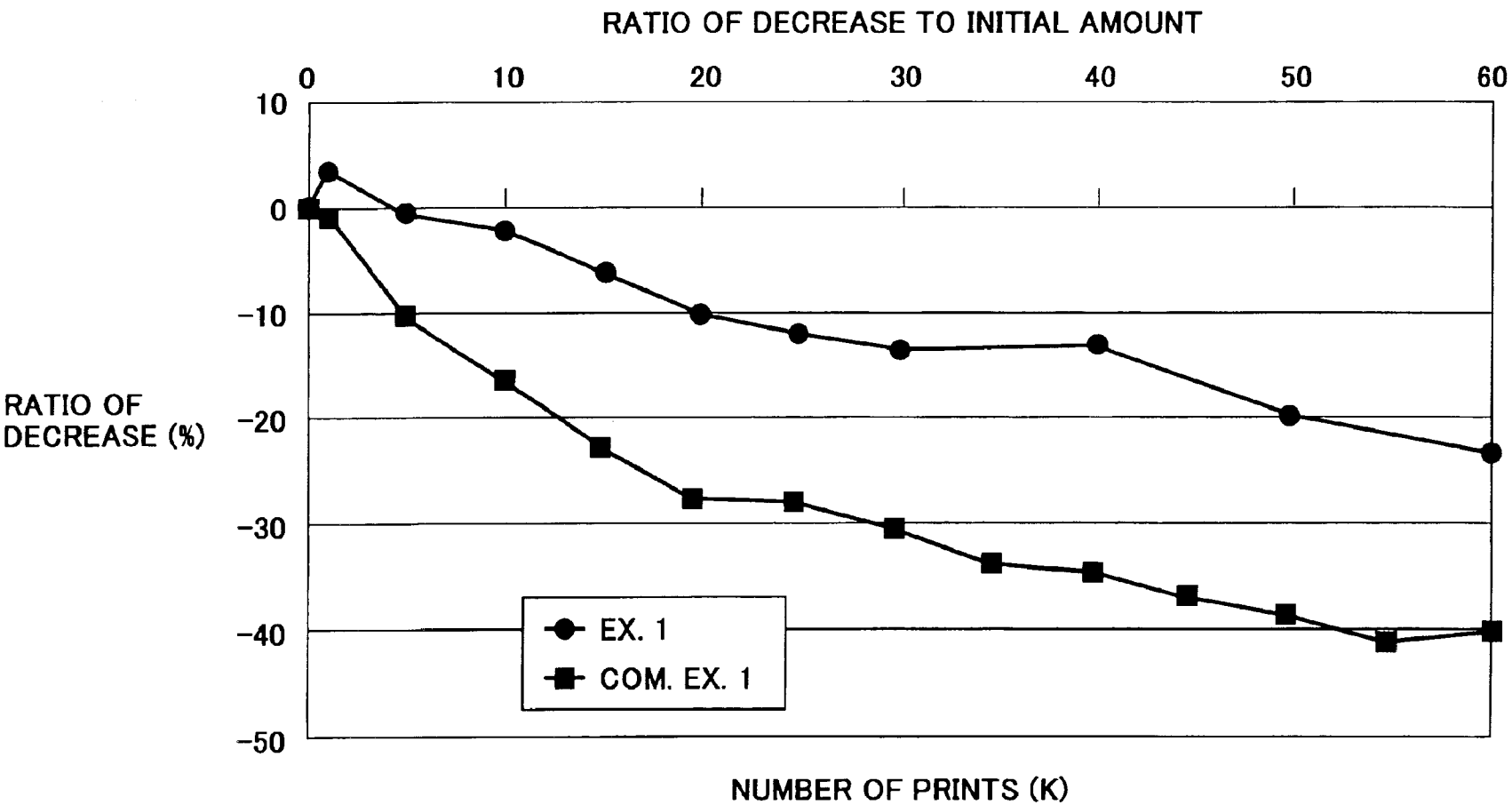
FIG. 2 is a graph showing how the amount of deposition of a developer decreases when magnetic carriers of Example 1 of the first embodiment and those of Comparative Example 1 are used.

The magnetic carrier grains of Example 1 and those of Comparative Example 1 each were set in a particular developing device having the construction of FIG. 1. A running test was conducted with the image forming apparatus including the developing device in a black mode up to 60,000 prints of size A4, which is a standard as to the life of a developer. The sleeve 7 had surface roughness Rz of 10 μm implemented by sand blasting. The shaft torque of the sleeve 7 was 1.2 kgf·cm. To measure the shaft torque, a developer containing the carrier grains of Comparative Example 1 and having a toner content TC controlled to 5% was used. After all gears other than the gear of the sleeve 7 had been removed, a torque gauge available from Tonichi Seisakusho was mounted to the shaft of the sleeve 7 so as to measure static torque by rotating the shaft by hand. In such conditions, the variation of the amount of the developer deposited on the sleeve 7 was measured. FIG. 2 shows how the amount of the developer decreased from the initial amount in accordance with the number of prints produced (%). It was experimentally found that when the ratio of decrease exceeded 30%, defective images including thin solid images and images with brush marks occurred. An allowable decrease level not effecting image quality is therefore selected to be 30%.

As FIG. 2 indicates, the carrier grains of Example 1 were superior to the carrier grains of Comparative Example 1 as to the variation of the amount of deposition. More specifically, the ratio of decrease achievable with Example 1 was only about 22%, which is far smaller than 30%, even when 60,000 prints of size A4 were produced.

The grain size of magnetic carrier grains will be described hereinafter in relation to Experiment 2.

EXPERIMENT 2

Use was made of magnetic carrier grains identical with those of Comparative Example 1 except that their grain size d was varied to 65 μm, 60 μm, 40 μm, 20 μm and 18 μm. Running tests were conducted in the same manner as in Experiment 1 up to 60,000 prints of size A4 in order to estimate a decrease in the amount of deposition. FIG. 3 shows the results of the running tests. As shown, the decrease in the amount of deposition achievable with the carrier grains of Example 1 did not reach 30% when 60,000 prints were produced, if the grain size was 20 μm or above. By contrast, the decrease in the amount of deposition particular to Comparative Example 1 could not be reduced below 30% unless the grain size was 65 μm or above.

Experiment 3 to be described hereinafter was conducted to determine the ratio D of the size of the grains contained in the coating layer of the carrier to the thickness h of the binder resin layer.

EXPERIMENT 3

Examples 2 and 3 were identical with Example 1 except that the thickness h of the binder resin layer was varied to implement ratios D/h of 3.8 and 9.7, respectively. Also, Example 4 was identical with Example 1 except that silica grains with a grain size of 0.2 μm and resistivity of $10^{13}$ Ω·cm were substituted for the alumina grains, and that the ratio D/h was 2.0. Further, Comparative Example 2 was identical with Example 1 except that titanium oxide grains with a grain size of 0.02 μm and resisivity of $10^7$ Ω·cm were substituted for the alumina grains, and that the ratio D/h was 0.13. Running tests identical with the running tests of Experiment 1 were conductive with Examples 1 through 4 and Comparative Example 2. FIG. 4 shows the results of the running tests. As shown, the ratio of decrease in the amount of deposition was smaller than 30% in all of Examples 2, 3 and 4 as in Example 1. By contrast, the ratio of decrease was as great as 40% in Comparative Example 2 and caused image defects including brush marks to occur.

By selecting the surface roughness Rz of the sleeve 7, the grain size d of the magnetic carrier grains and the properties of the coating layer (grain size D and thickness D/h) as stated above, it is possible to prevent the amount of deposition from decreasing below the level that effects image quality. To further reduce the decrease in the amount of deposition, it is preferable to further reduce the deterioration of the carrier grains. The size of stress to act on the carrier grains is greatly dependent on the ratio of the grain size d of the carrier grains to the surface roughness Rz of the sleeve 7, i.e., d/Rz. More specifically, the smaller the ratio d/Rz, the heavier the stress. Experiment 4 to be described hereinafter was conducted to examine the ratio d/Rz and the deterioration of the carrier grains.

EXPERIMENT 4

In the image forming apparatus used in Experiment 1, the surface roughness Rz of the sleeve 7 was varied to 4, 5, 12, 20 and 30. Use was made of carrier grains identical with those of Example 1 except that their grain size d was varied to 14 μm, 22 μm, 36 μm, 40 μm, 60 μm, 70 μm and 80 μm. Running tests were conducted in the same manner as in Experiment 1 to estimate the decrease in the amount of deposition. Further, after 60,000 prints of size A4 had been produced, the surfaces of the individual carrier grains were observed with a canning electron microscope to estimate the peeling of the coating layers and carrier spent condition. The results of the running tests are shown in FIG. 5.

As FIG. 5 indicates, when the surface roughness Rz was between 5 μm and 20 μm and when the carrier grain size d was between 22 μm and 60 μm, the ratio of decrease in the amount of deposition did not reach 30% after the 60,000 running test. Particularly, when the ratio d/Rz was greater than or equal to 3, the carrier grains were desirable as to both of peeling and carrier spent condition, i.e., deterioration ascribable to aging was little. However, when the ratio d/Rz was smaller than 3, peeling and carrier spent condition occurred, i.e., the developer was noticeably deteriorated. On the other hand, when the ratio d/Rz was greater than 5, the stress and therefore the deterioration of the developer was unnoticeable, but the ratio of decrease in the amount of deposition exceeded the allowable level. It follows that by confining the ratio d/Rz in the range of $3 \leqq d/Rz \leqq 5$, it is possible to reduce the deterioration of the carrier grains and therefore the developer while further reducing the decrease in the amount of deposition.

The grains to be contained in the coating layers should preferably be formed of, e.g., alumina or silica, as stated in relation to Examples 1 through 4. If the alumina or silica content of the individual coating layer is between 50 wt % and 95 wt %, preferably 70 wt % and 90 wt %, then the advantage is further enhanced. Alumina and silica may be mixed together, if desired. If the grain content is below 50 wt %, then the grains occupy a smaller area of the individual carrier grain than the binder resin and cannot absorb impactive contact to act on the binder resin, failing to provide the carrier grains with sufficient durability. If the grain content is above 95 wt %, then the ratio in area of the grains to the binder resin expected to generate charging is so great, charging is obstructed. In addition, the grain holding ability of the binder resin decreases, i.e., the grains easily part from the binder resin, degrading durability.

Laid-Open Publication No. 9-160304 mentioned earlier differs from the illustrative embodiment as to the range of grain content of the coating layer as well. Specifically, the above document describes that the grain content is 0.01 wt % to 50 wt % of the coating resin, i.e., 0.01 wt % to 33.33 wt % of the coating layer in terms of the content of the illustrative embodiment. Although such a range improves durability, the ratio in area of the grains to the binder resin is to small too absorb impactive contact to act on the binder resin, preventing sufficient durability from being achieved.

To reduce the stress to act on the developer for thereby reducing the decrease in the amount of deposition, the shaft torque of the sleeve 7 should preferably be small. However, if the shaft torque is excessively small, then the toner grains cannot be stably charged. In Experiment 5 to be described hereinafter, the shaft torque was varied to examine the charging of the toner grains and the decrease in the amount of deposition.

EXPERIMENT 5

In the image forming apparatus used in Experiment 1, the shaft torque of the sleeve 7 was varied to 0.4 kgf·cm, 0.5 kgf·cm, 1.0 kgf·cm, 2.0 kgf·cm, 4.0 kgf·cm and 4.5 kgf·cm. The magnetic carrier grains of Example 1 and Comparative Example 1 were also used. Running tests were conducted in the same manner as in Experiment 1 to estimate the decrease in the amount of deposition and the charging of the toner grains. The results of the running tests are shown in FIG. 6.

As FIG. 6 indicates, when the carrier grains of Example 1 were used, the shaft torque of the sleeve 7 between 0.5 kgf·cm and 4.0 kgf·cm was satisfactory as to both of the decrease in the amount of deposition and the charging of the toner grains. By contrast, when the carrier grains of Comparative Example 1 were used, the shaft torque of 0.5 kgf·cm or above deteriorated the developer and thereby reduced the amount of deposition although implementing the stable charging of the toner grains. Further, the shaft torque of 4.0 kgf·cm or above critically deteriorated the developer and prevented the toner grains from being stably charged.

Now, the diameter of the sleeve 7 should preferably be as small as possible from the space and cost standpoint. However, for given linear velocity, the smaller the diameter of the sleeve 7, the more frequent the conveyance of the developer to the developing position, accelerating the deterioration of the developer. If the diameter and therefore the circumferential length of the sleeve 7 is small, then the sleeve 7 noticeably wears and looses durability. Moreover, if the diameter of the sleeve 7 is small, then the number of magnetic poles than can be accommodated in the sleeve 7 is reduced with the result that the developer is prevented from being smoothly circulated between the poles in the returning direction. This impairs the distribution and agitation of the developer on the sleeve 7, resulting in irregular deposition, as will be described hereinafter.

EXPERIMENT 6

Use was made of the magnetic carrier grains of Example 1 and Comparative Example 1 while the diameter of the sleeve 7 was varied to 12 mm, 15 mm, 25 mm, 35 mm and 40 mm. Only the developing unit was idled for a period of time corresponding to 60,000 prints of size A4 in order to estimate the decrease in the amount of deposition. FIG. 7 shows the result of Experiment 6. As shown, when the carrier grains of Example 1 were used, the sleeve diameter of 12 mm caused the amount of deposition to decrease and caused irregular deposition and carrier deposition to occur as well. The sleeve diameter of 15 mm or above did not cause the amount of deposition to decrease below the allowable level or did not bring about irregular deposition or carrier deposition. The magnetic carriers of Comparative Example 1 caused the amount of deposition to decrease when the sleeve diameter was 12 mm and caused irregular deposition and carrier deposition to occur as well. Although irregular deposition and carrier deposition did not occur when the sleeve diameter was between 15 mm and 35 mm, the amount of deposition decreased due to the deterioration of the developer; the sleeve diameter should be 40 mm or above to confine the decrease in the allowable range.

If the linear velocity of the sleeve 7 is high, then heavy stress acts on the developer and causes the developer to deteriorate due to aging, resulting in the critical decrease in the amount of deposition that would effect image quality. This will be described hereinafter in relation to Experiment 7.

EXPERIMENT 7

Use was made of the magnetic carrier grains of Example 1 and Comparative Example 1 while the linear velocity of the sleeve 7 was varied to 130 mm/sec, 150 mm/sec, 300 mm/sec, 700 mm/sec and 750 mm/sec. As for the other conditions, Experiment 7 was conducted in the same manner as Example 1 to estimate the decrease in the amount of deposition. As shown in FIG. 8, the amount of deposition of the carrier grains of Example 1 did not decrease below 30% when the linear velocity was between 130 mm/sec and 700 mm/sec. However, when the linear velocity was 750 mm/sec, the stress acting on the developer was so heavy, the amount of deposition decreased by more than 30%. On the other hand, in Comparative Example 1, the amount of deposition decreased by more than 30% when the linear velocity was between 150 mm/sec and 750 mm/sec due to heavy stress; the decrease could not be reduced unless the linear velocity was as low as 130 mm/sec or below.

In the illustrative embodiment, the doctor 9 is formed of a magnetic material, as stated earlier. Therefore, a force for retaining the developer at a position short of the doctor 9 increases and allows the decrease in the amount of deposition to be easily reduced. However, the stress to act on the developer increases with the increase in retaining force. In this sense, the carrier grains described above successfully decelerate the deterioration of the developer for thereby obviating the decrease in the amount of deposition.

As stated above, the illustrative embodiment conveys a stable amount of developer to the developing position by reducing a decrease in the amount of developer to deposit on the sleeve 7, thereby insuring high image quality over a long term.

Second Embodiment

This embodiment mainly addresses to the problem (2) stated earlier. The illustrative embodiment is also practicable with the developing unit shown in FIG. 1 and the carrier grains and coating layers of the first embodiment. The following description will therefore concentrate on the characteristics of the illustrative embodiment.

A gap Gp for development between the sleeve 7 of the developing unit 1, FIG. 1, and the drum 8 should be small in order to enhance the developing ability and to enhance image quality by obviating the deposition of carrier grains on the drum 8. First, Experiment 1 pertaining to a relation between the gap Gp and image quality will be described hereinafter.

EXPERIMENT 1

The gap Gp was varied to 0.6 mm, 0.5 mm and 0.4 mm to estimate the granularity of an image, i.e., irregularity among dots forming an image; the smaller the granularity, the higher the image quality. The target granularity is 0.5 or below. Experiments showed that granularity of 0.5 or below was acceptable as to image quality. More specifically, as shown in FIG. 9, when the gap Gp was 0.4 mm or below, granularity was less than the target granularity of 0.5.

Experiment 2 pertaining to the relation between the gap Gp for development and the carrier deposition on the drum 8 will be described hereinafter.

EXPERIMENT 2

Figure 10:
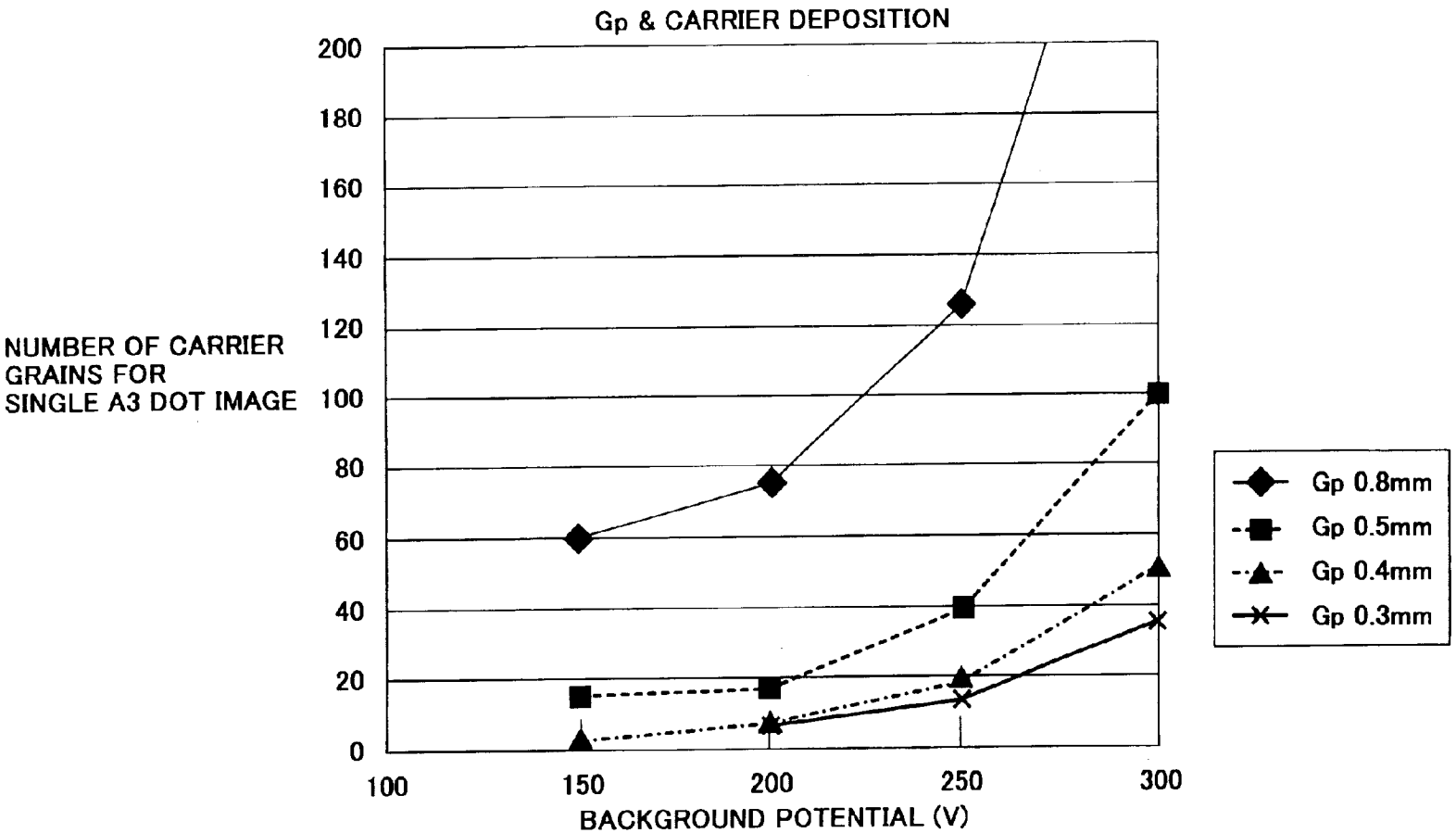
FIG. 10 is a graph showing a relation between a gap for development and carrier deposition particular to the second embodiment.

In the developing device 1, the gap Gp was varied to 0.8 mm, 0.5 mm, 0.4 mm and 0.3 mm to estimate carrier deposition. For the estimation, dot images most severely conditioned as to carrier deposition were formed and subjected to severe acceleration measurement with background potential being varied. For background potential of 200 V, carrier deposition may be considered to be acceptable if twenty or less carrier grains deposit on the background of a single print of size A3 or excellent if ten or less carrier grains deposit. As shown in FIG. 10, carrier deposition was desirably reduced when the gap Gp was 0.4 mm or below.

In light of the above, in the illustrative embodiment, the gap Gp between the sleeve 7 and the drum 8 is selected to be 0.4 mm or below for enhancing the developing ability and image quality.

Figure 11:
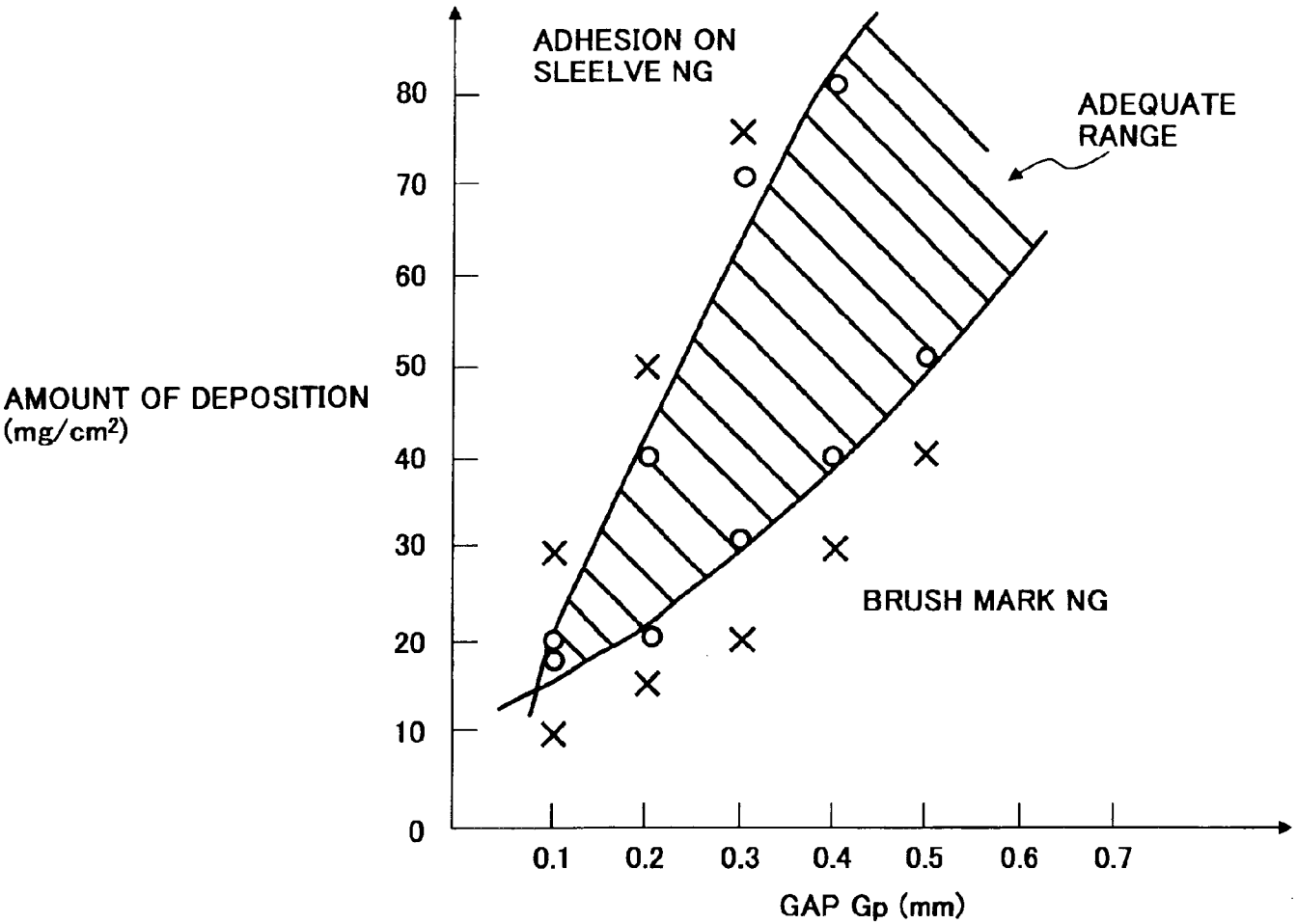
FIG. 11 is a graph showing a relation between the gap for development corresponding to the gap Gp of FIG. 10 and the adequate range of the amount of deposition.

Reference will be made to FIG. 11 for describing a relation between the gap Gp and the amount of deposition of the developer on the sleeve 7. If the amount of the developer deposited on the sleeve 7 is short, then brush marks appear in an image and degrade image quality. The lower limit of the amount of deposition is therefore selected in a range that does not cause brush marks to appear. On the other hand, if the amount of deposition is great, then the developer adheres to the sleeve 7 when packed in the gap Gp. In light of this, the upper limit of the amount of deposition is selected in a range that does not cause the developer to adhere to the sleeve 7.

As FIG. 11 indicates, when the gap Gp is reduced to 0.4 mm and below, the upper limit of the amount of deposition sharply falls while the lower limit rises, narrowing the adequate range of the amount of deposition. More specifically, when the gap Gp is 0.4 mm, the adequate range is between 40 mg/cm$^2$ and 75 mg/cm$^2$, so that the allowable width is 35 mg/cm$^2$. When the gap Gp is 0.5 mm, the adequate range is between 45 mg/cm$^2$ and 90 mg/cm$^2$, so that the allowable width is 45 mg/cm$^2$.

Examples of the illustrative embodiment and Comparative Examples (conventional carrier grains) will be described hereinafter.

EXAMPLE 1

56.0 parts of acrylic resin solution (50 wt % of solid), 15.6 parts of guanamine solution, 160.0 parts of alumina grains (0.3 $\mu$m; resistivity of $10^{14}$ Ω·cm), 900 parts of toluene and 900 parts of butyl cellosolve were dispersed in a homomixer for 10 minutes to thereby prepare a film forming solution. The film forming solution was coated on cores, which were implemented by sintered ferrite F-300, by Spilacoater to thickness of 0.15 $\mu$m and then dried. The resulting carrier grains were left in an electric furnace at 150° C. for 1 hour. The carrier grains had a weight-mean grain size of 35 $\mu$m. The ratio of the grain size D (0.3 m) of the alumina grains contained in the coating layer to the thickness h (0.15 $\mu$m) of the binder resin layer, i.e., D/h is 2.0.

Again, the above thickness of the binder resin layer is represented by the mean thickness of the layers of the carrier grains.

COMPARATIVE EXAMPLE 1

56.0 parts of acrylic resin solution (50 wt % of solid), 15.6 parts of guanamine solution (77 wt % of solid), 900 parts of toluene and 900 parts of butyl cellosolve were dispersed in a homomixer for 10 minutes to thereby prepare a film forming solution. The film forming solution was coated on cores, which were also implemented by the sintered ferrite F-300, by Spilacoater to thickness of 0.15 $\mu$m and then dried. The resulting carrier grains were left in an electric furnace at 150° C. for 1 hour and then cooled off. The carrier grains had a weight-beam grain size of 35 $\mu$m.

EXPERIMENT 3

The carrier grains of Example 1 and those of Comparative Example 1 each were set in a particular developing unit each having the configuration of. FIG. 1 and then subjected to an A4, 200,000 running test under the following conditions:

| | | |
|---|---|---|
| drum linear velocity | 185 | mm/sec |
| drum diameter | 30 | mm |
| sleeve/drum linear velocity ratio | 1.51 | |
| gap Gp for development | 0.4 | mm |
| doctor gap Gd | 0.65 | mm |
| initial amount of deposition | 60 | mg/cm2 |
| sleeve diameter | 18 | mm |
| main pole angle | 0° | |

-continued

| | |
|---|---|
| main pole flux density | 66 mT |
| pole flux density facing doctor | 66 mT |
| charge potential V0 | −700 V |
| potential VL after development | −60 V |
| development bias VB | −500 V |

Figure 12:
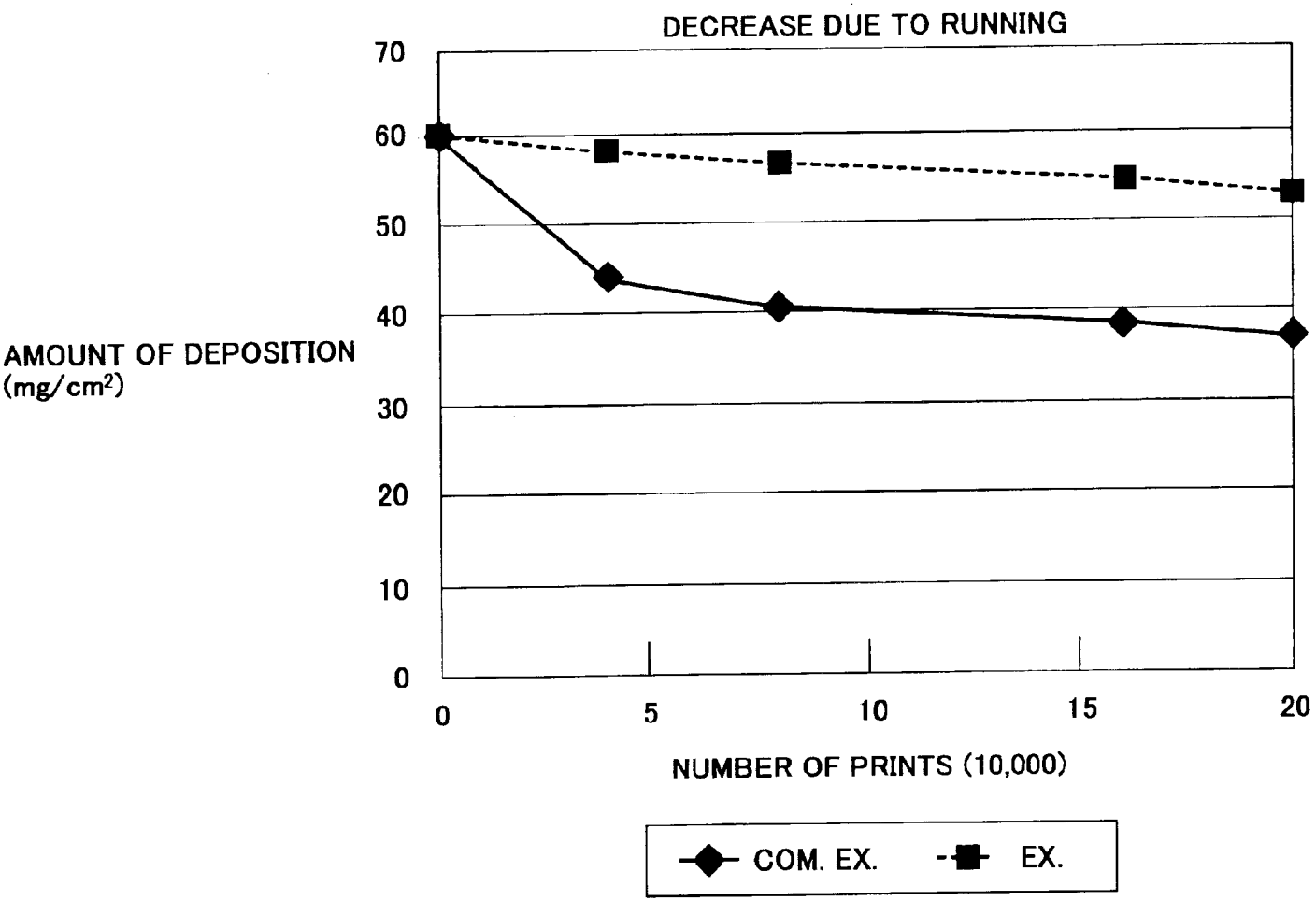
FIG. 12 is a graph showing how the amount of deposition decreases when magnetic carrier grains of Example 1 of the second embodiment and those of Comparative Example 1 are used.

FIG. 12 shows how the amount of deposition varied during the running test effected under the above conditions. As shown, the carrier grains of Example 1 varied less than the carrier grains of Comparative Example 1 as to the amount of deposition and were deposited in an amount of 55 $mg/cm^2$ even when 200,000 prints of size A4 were produced; the decrement was as small as 5 $mg/cm^2$ lying in the allowable width. By contrast, the amount of deposition of the carrier grains particular to Comparative Example 1 decreased to 40 $mg/cm^2$ when 200,000 prints were produced, causing image defects including brush marks to appear.

While the bias VB for development is assumed to be DC, use may be made of AC-biased DC, if desired.

The weight-mean grain size d of the carrier grains will be described hereinafter. The carrier grains applied to the developing unit 1 should preferably be small enough to obviate brush marks ascribable to the carrier grains as well as granularity. FIG. 13 shows granularity estimated by varying the weight-mean grain size of the carrier grains to 80 μm, 60 μm and 35 μm. For the estimation, the gap Gp for development was selected to be 0.4 mm. As FIG. 13 indicates, the target granularity of 0.5 or below was achieved when the weight-mean grain size d was 60 μm or below.

On the other hand, magnetization for a single carrier grain and the magnetic force to act on the carrier grain decrease with a decrease in carrier grain size, so that the amount of deposition of the developer on the sleeve and carrier deposition on the drum tend to be aggravated. This will be described hereinafter in relation to Experiment 4.

EXPERIMENT 4

Use was made of magnetic carrier grains identical with those of Comparative Example 1 except that their weight-mean grain size d was varied to 65 μm, 60 μm, 40 μm, 20 μm and 18 μm. Running tests were conducted in the same manner as in Experiment 3 up to 60,000 prints of size A4 in order to estimate a decrease in the amount of deposition FIG. 3 shows the results of the running tests. As shown, the decrease in the amount of deposition achievable with the carrier grains of Example 1 was confined in the allowable range if the weight-mean grain size d was 20 μm or above. By contrast, the decrease in the amount of deposition particular to Comparative Example 1 could not be confined in the allowable range unless the weight-mean grain size d was 65 μm or above.

It was found that by the same method as in Experiment 2 when the weight-mean grain size d of the carrier grains was 20 μm or above, carrier deposition on the drum was also confined in the allowable range. It follows that image quality can be further enhanced if the weight-mean grain size d is between 20 μm and 60 μm.

As stated above, the illustrative embodiment also enhances the developing ability and reduces the decrease in the amount of deposition of the developer. This allows a stable amount of developer to be conveyed to the developing position for thereby insuring high image quality over a long term.

Third Embodiment

This embodiment mainly addresses to the problem (3) stated earlier. The illustrative embodiment is also practicable with the developing unit shown in FIG. 1 and the carrier grains and coating films of the first embodiment. The following description will therefore concentrate on the characteristics of the illustrative embodiment.

In the illustrative embodiment, the shaft torque of the sleeve 7 is selected to be between 0.5 kgf·cm and 4.0 kgf·cm. The shaft torque was measured by the procedure stated earlier.

The cores of the carrier grains should preferably have a weight-mean grain size of 20 μm or above for obviating carrier deposition on the drum 8, but 100 μm or below for obviating brush marks and other image defects.

The resisivity of the grains contained in the coating layers should preferably be $10^{12}$ Ω·cm or above because, even if the grains are exposed to the outside while contacting the cores, such resistivity obviates the leak of charge for thereby insuring stable charging. In addition, the amount of charge is prevented from decreasing when the developer is stored over a long period of time. Further, when the grains are formed of alumina and when the grain content of the individual coating layer is between 50 wt % and 95 wt %, preferably 70 wt % and 90 wt %, the above advantages are further enhanced. Alumina and silica may be mixed together, if desired. If the grain content of the coating layer is below 50 wt %, then the grains occupy a smaller area of the individual carrier grain than the binder resin and cannot absorb impactive contact to act on the binder resin, failing to provide the carrier grains with sufficient durability. If the grain content is above 95 wt %, then the ratio in area of the grains to the binder resin expected to generate charging is so great, charging is obstructed. In addition, the grain holding ability of the binder resin decreases, i.e., the grains easily part from the binder resin, degrading durability.

The toner grains forming the developer together with the carrier grains may be produced by any one of conventional methods. In accordance with one of conventional methods, a mixture of binder resin, colorant and polarity control agent is kneaded in a thermal roll mill, solidified by cooling, pulverized, and then classified. Any suitable additive or additives may be added to the above mixture.

As for binder resin, use may be made of, e.g., a monomer of polystyrene, poly-p-styrene, polyvinyl toluene or similar ethylene or a substitution product thereof; styrene-p-chlorostyrene copolymer, styrene-propylene copolymer, styrene-vinyl toluene copolymer, styrene-methyl acrylate copolymer, styrene-ethyl acrylate copolymer, styrene-butyl acrylate copolymer, styrene-methyl methacrylate copolymer, styrene-butyl methacrylate copolymer, styrene-a-methyl chlorometacrylate copolymer, styrene-acrylonitrile copolymer, styrene-butadien copolymer, styrene-isoprene copolymer, styrene-maleic copolymer, styrene-ester maleic ester copolymer or similar styrene copolymer; polymethacrylate, polybuthylmethacrylate, polyvinyl chrloride, polyvinyl acetate, polyethylene, polypropylene, polyester, polyurethane, polyamide, polybutyral, polyacrylic acid resin, rosin, modified rosin, phenol resin, fatty hydrocarbon resin, aromatic petroleum resin, chlorinated paraffin or paraffin wax. Such binder resins may be used either singly or in combination.

As for the polarity control agent, use may be made of, e.g., a metal complex of monoazo dye, nitrohumic acid and salts thereof, an amino compound of salicylic acid, naphthoic acid or dicarboxilic acid with Co, Cr, Fe or similar metal complex, quaternary ammonium compound or organic dye. The amount of the polarity control agent applicable to the toner is dependent on the kind of the binder resin, whether or not additives are added, and a toner producing method including a dispersing method. However, the amount of the polarity control agent should preferably be 0.1 part to 20 parts by weight for 100 parts of binder resin. The amount of the polarity control makes the amount of charge of the toner short and impractical if less than 0.1 part by weight or makes it excessive and thereby intensifies electrostatic attraction between the toner and the carrier if greater than 20 parts by weight. The intensified electrostatic attraction would make the fluidity of the developer short or would lower image density.

A black colorant contained in the toner may be any one of, e.g., carbon black, Aniline Black, furnace black, and lamp black. A cyan colorant may be any one of Phthalocyanine Blue, Methylene Blue, Victoria Blue, Methyl Violet, Aniline Blue, and Ultramarine Blue. A magenta colorant may be any one of, e.g., Rhodamine 6G Lake, dimethyl quidacrydone. Watching Red, Rose Bengale, Rhodamine B, and Alizarine Lake. A yellow colorant may be any one of, e.g., Chrome Yellow, Bensidine Yellow, Hansa Yellow, Naphthol Yellow, Molybdenum Orange, Quinoline Yellow, and Tartrazine Yellow.

The toner may contain a magnetic substance. The magnetic substance may be any one of, e.g., magnetite, hematite, ferrite or similar ion oxide, iron, cobalt, nickel or similar metal, and an alloy or a mixture of such metal with aluminum, cobalt, copper, lead, magnesium, tin, zinc, antimony, beryllium, bismuth, cadmium, calcium, manganese, selenium, titanium, tungsten, vanadium or similar metal. Such a ferromagnetic material should preferably have a mean grain size of 0.1 $\mu$m to 2 $\mu$m and should preferably be contained in the toner in an amount of about 20 parts by weight to 200 parts by weight, more preferably 40 parts by weight to 150 parts by weight, for 100 parts by weight of resin.

The additives that may be added to the toner include cerium oxide, silicon oxide, titanium oxide, silicon carbide and other inorganic powders. Among them, coloidal silica is preferable.

A parting agent for oil-less fixation may be any one of, e.g., solid silicone vanish, montan-based ester wax, rice wax oxide, low molecular weight polypropylene wax, and carnauba wax.

The carrier of the illustrative embodiment will be described in relation to Example and Comparative Example (conventional carrier) as well as experiments conducted therewith.

EXAMPLE 56.0 parts of acrylic resin solution (50 wt % of solid), 15.6 parts of guanamine solution, 160.0 parts of alumina grains (0.3 $\mu$m; resistivity of $10^{14}$ Ω·cm), 900 parts of toluene and 900 parts of butyl cellosolve were dispersed in a homomixer for 10 minutes to thereby prepare a film forming solution. The film forming solution was coated on cores, which were implemented by sintered ferrite F-300 by Spilacoater to thickness of 0.15 $\mu$m and then dried. The resulting carrier grains were left in an electric furnace at 150° C. for 1 hour and then cooled off. The resulting ferrite powder bulk was classified by a 100 $\mu$m sieve to thereby produce carrier grains. The ratio of the grain size D (0.3 m) of the alumina grains contained in the coating layers to the thickness h (0.15 $\mu$m) of the binder resin layer, i.e., D/h is 2.0.

Again, the thickness of the binder resin layer is represented by the mean thickness of the layers of the carrier grains.

COMPARATIVE EXAMPLE 56.0 parts of acrylic resin solution (50 wt % of solid), 15.6 parts of guanamine solution (77 wt % of solid), 900 parts of toluene and 900 parts of butyl cellosolve were dispersed in a homomixer for 10 minutes to thereby prepare a film forming solution. The film forming solution was coated on cores, which were also implemented by the sintered ferrite F-300, by Spilacoater to thickness of 0.15 $\mu$m and then dried. The resulting carrier grains were left in an electric furnace at 150° C. for 1 hour and then cooled off. The resulting ferrite powder bulk was classified by a 100 $\mu$m sieve to thereby produce carrier grains.

EXPERIMENT 1

Figure 15:
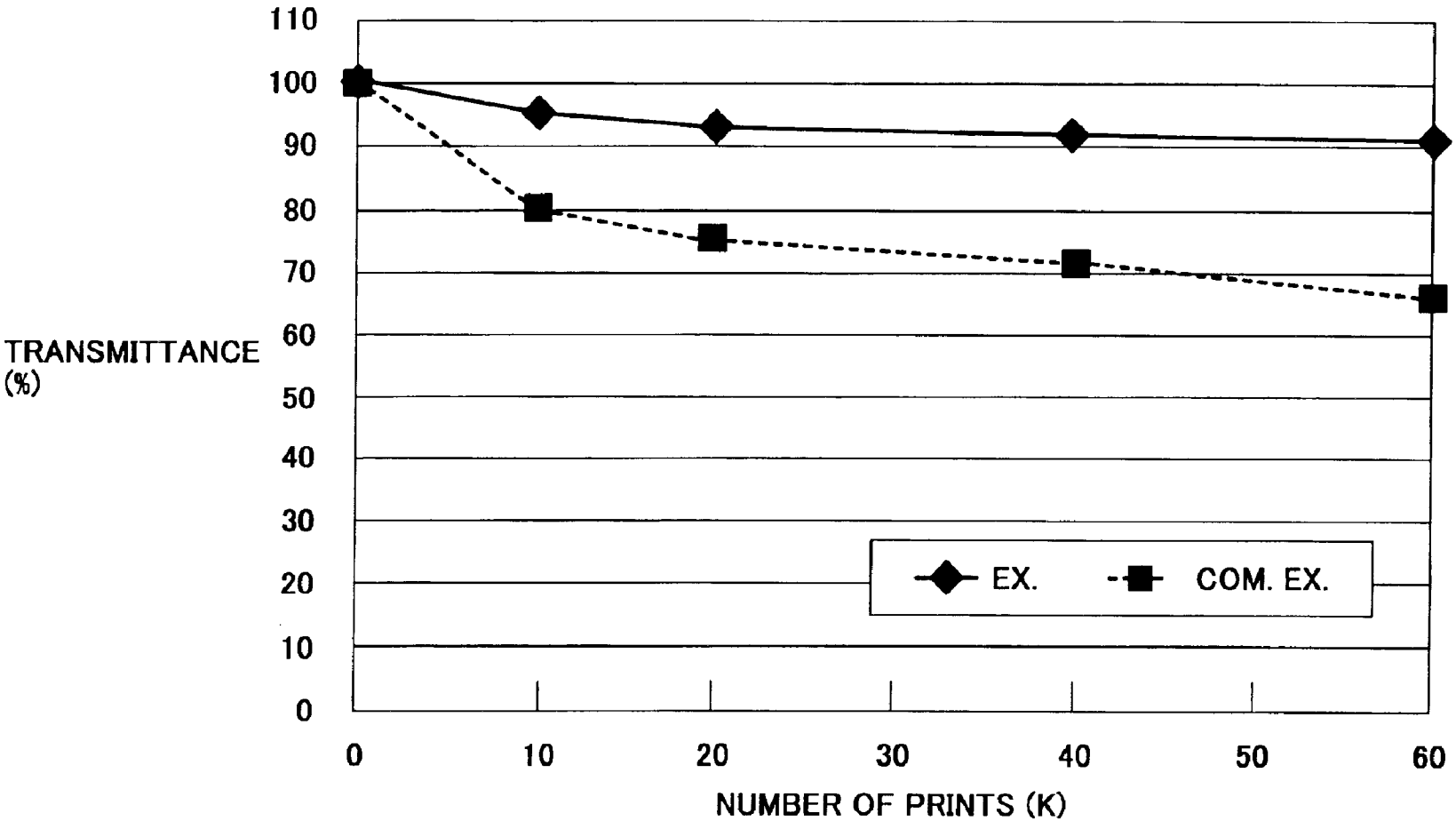
FIG. 15 is a graph showing how transmittance varies with the elapse of time when carrier grains of Example of the third embodiment and those of Comparative Example are used.

Developers containing magnetic carrier grains of Example and those of Comparative Example, respectively, each were set in a particular developing device having the construction of FIG. 1. Toner grains did not contain wax. The shaft torque of the sleeve 7 was selected to be 1.0 kgf·cm while the flux density in the normal direction, as measured on the surface of the sleeve 7 facing the doctor 9, was selected to be 55 mT. Running tests were conducted with the image forming apparatus including the developing device in a black mode up to 60,000 prints of size A4 in order to estimate the toner spent condition on the carrier grains. FIG. 15 shows the results of estimation.

To measure the toner spent condition, 10 grams of solvent (MEK) was added to 1 gram of carrier grains prepared by removing the toner grains from the developer. The solvent was then shaken eighty times. Thereafter, a spent condition was measured in terms of the transmittance of the solvent by use of a turbidimeter. Transmittance is 100% in the initial condition wherein the toner grains are free from the spent condition; lower transmittance indicates the aggravation of the toner spent condition. When transmittance decreases below 80%, the toner grains cannot be stably, adequately charged, resulting in background contamination or toner scattering, as determined by experiments. In light of this, in the illustrative embodiment, an allowable transmission level that obviates background contamination and toner scattering is selected to be 80%.

As FIG. 15 indicates, the transmission of Example decreased less than the transmission of Comparative Example and remained at 90% higher than 80% even when 60,000 prints of size A4 were produced. By contrast, the transmittance of Comparative Example decreased below 70% when 60,000 prints were produced, resulting in background contamination and toner scattering.

EXPERIMENT 2

In the developing unit 1, the shaft torque of the sleeve 7 was varied to 0.4 kgf·cm, 0.5 kgf·cm, 1.0 kgf·cm, 2.0 kgf·cm, 4.0 kgf·cm and 4.5 kgf·cm. The magnetic carrier grains of Example and Comparative Example were used. Running tests were conducted in the same manner as in Experiment 1 to estimate the decrease in the charging of the toner grains and the toner spent condition on the carrier grains. The results of the running tests are shown in FIG. 16.

As FIG. 16 indicates, when the carrier grains of Example were used, the shaft torque of the sleeve 7 between 0.5 kgf·cm and 4.0 kgf·cm was satisfactory as to both of the charging of the toner grains and the toner spent condition. By contrast, when the carrier grains of Comparative Example were used, the shaft torque of 0.5 kgf·cm or above aggravated the toner spent condition although implemented the stable initial charging of the toner grains.

Figure 17:
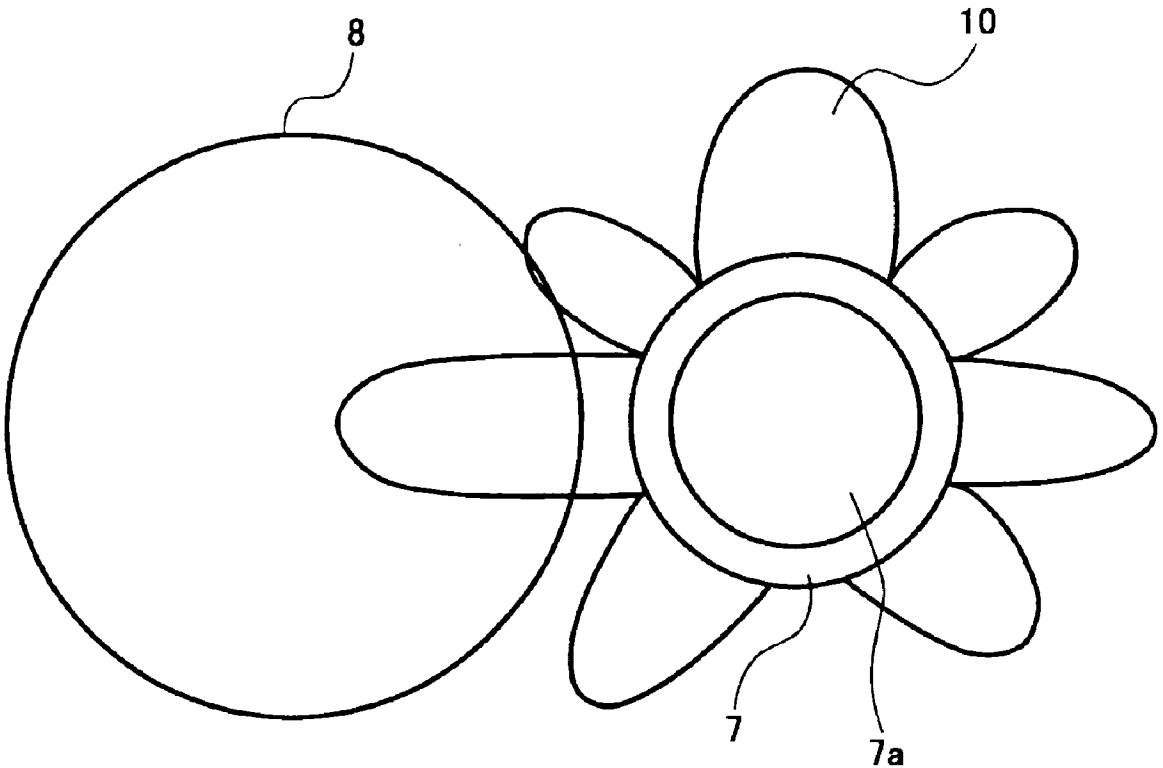
FIG. 17 shows the flux density distribution of a magnet roller included in the third embodiment.

In the illustrative embodiment the doctor 9 is also formed of a magnetic material in order to cause more developer to exist at a position downstream of the doctor 9, thereby maintaining the conveyance of the developer to the developing position stable. As shown in FIG. 17, the magnet roller 7*a* disposed in the sleeve 7*a* includes a pole 10 facing the doctor 9 not shown. In the illustrative embodiment the pole 10 is provided with high flux density in the normal direction, as measured on the surface of the sleeve 7. This, however, tends to make stress to act on the developer heavy and aggravate the toner spent condition. In addition, when the toner grains contain wax, the wax is apt to leak to the surfaces of the toner grains, further aggravating the toner spent condition. This will be described hereinafter in relation to Experiment 3.

EXPERIMENT 3

The flux density of the pole 10, which faces the doctor 9, in the normal direction was varied to 40 mT, 45 mT, 55 mT, 60 mT, 75 mT and 80 mT. Flux density was measured by use of a magnetic force distribution gauge available from Excel System Product and a gauss meter available from ADS. Developers containing the carrier grains of Example and those of Comparative Example, respectively, each were set in a developer having the configuration of FIG. 1. Running tests were conducted in the same manner as in Experiment 1 up to 60,000 prints of size A4 in order to estimate the toner spent condition on the carrier grains. The experiment and estimation were also effected with a nonmagnetic doctor. Similar experiments and estimation were also effected with wax-containing toner grains. The results of experiments and estimations are shown in FIG. 18.

As FIG. 18 indicates, When the shaft torque of the sleeve 7 was 4.0 kgf·cm or below, Example reduced the toner spent condition. This was also true when the flux density of the pole 10 was 75 mT or below. On the other hand, Experiment 2 stated earlier indicates that to insure stable charging of the toner, the shaft torque of the sleeve 7 should be 0.5 kgf·cm or above, i.e., the flux density of the pole 10 should be 45 mT or above. By contrast, Comparative Example failed to reduce the toner spent condition with the flux density of 45 mT or above unless the shaft torque of the sleeve 7 was reduced below 0.5 kgf·cm.

Even the nonmagnetic doctor was found to reduce the toner spent condition. This was also true with the wax-containing toner grains.

As stated above, the illustrative embodiment reduces the toner spent condition and insures stable conveyance of the developer to the developing position over a long term for thereby insuring high image quality.

Fourth Embodiment

This embodiment mainly addresses to the problem (4) stated earlier. The illustrative embodiment is also practicable with the developing unit shown in FIG. 1 and the carrier grains and coating films of the first embodiment. The following description will therefore concentrate on the characteristics of the illustrative embodiment.

In the illustrative embodiment, to reduce the size of the image forming apparatus, the drum 8 and sleeve 7 were provided with diameters of 60 mm or below and 30 mm or below, respectively. The magnetic carrier grains had a mean-weight grain size d of 20 μm or above, but 40 μm or below.

The illustrative embodiment will be described in relation to experiments specifically. To produce magnetic carrier grains 1 (illustrative embodiment), 56.0 parts of acrylic resin solution (50 wt % of solid), 15.6 parts of guanamine solution (77 wt % of solid), 160.0 parts of alumina grains with a grain size of 0.3 μm and resistivity of $10^{14}$ Ω·cm, 900 parts of toluene and 900 parts of butyl cellosolve were dispersed in a homomixer for 10 minutes to thereby prepare a film forming solution. The film forming solution was coated on cores, which were also implemented by the sintered ferrite F-300, by Spilacoater to thickness of 0.15 μm and then dried. The resulting carrier grains were left in an electric furnace at 150° C. for 1 hour, cooled off, and then classified by a 100 μm sieve. The ratio of the grain size D (0.3 μm) of the alumina grains contained in the coating layers to the thickness h (0.15 μm) of the binder resin layers is 2.0. The carrier grains had volume resistivity of $10^{15}$ Ω·m.

Again, the thickness of the binder resin layer is represented by the mean thickness of the binder resin layers. Also, to measure the volume resistivity of the carrier grains, the carrier grains were positioned between parallel electrodes spaced from each other by a gap of 2 mm, and DC 500 V was applied between the electrodes for 30 seconds. The resulting resistance was measured and then converted to volume resistivity.

To produce magnetic carrier grains 2 (conventional small-size carrier grains), 56.0 parts of acrylic resin solution (50 wt % of solid), 15.6 parts of guanamine solution (77 wt % of solid), 900 parts of toluene and 900 parts of butyl cellosolve were dispersed in a homomixer for 10 minutes to thereby prepare a film forming solution. The film forming solution was coated on cores, which were also implemented by the sintered ferrite F-300, by Spilacoater to thickness of 0.15 μm and then dried. The resulting carrier grains were left in an electric furnace at 150° C. for 1 hour, cooled off, and then classified by a 100 μm sieve.

EXPERIMENT 1

The carrier grains 1 and 2 each were set in a particular developing unit each having the configuration of FIG. 1 and then subjected to an A4, 300,000 running test under the following conditions:

| | | |
|---|---|---|
| drum linear velocity | 300 | mm/sec |
| drum diameter | 30 | mm |
| sleeve/drum linear velocity ratio | 2 | |
| gap Gp for development | 0.4 | mm |
| doctor gap Gd | 0.65 | mm |
| initial amount of deposition | 60 | mg/cm$^2$ |
| sleeve diameter | 25 | mm |
| main pole angle | 0° | |
| main pole flux density P1 | 66 | mT |
| pole flux density P2 downstream of main pole | 85 | mT |
| charge potential VD | −700 | V |
| potential VL after development | −60 | V |
| development bias. Vb | −500 | V |

The flux density was measured by the magnetic force distribution gauge and gauss meter mentioned earlier.

Figure 19:
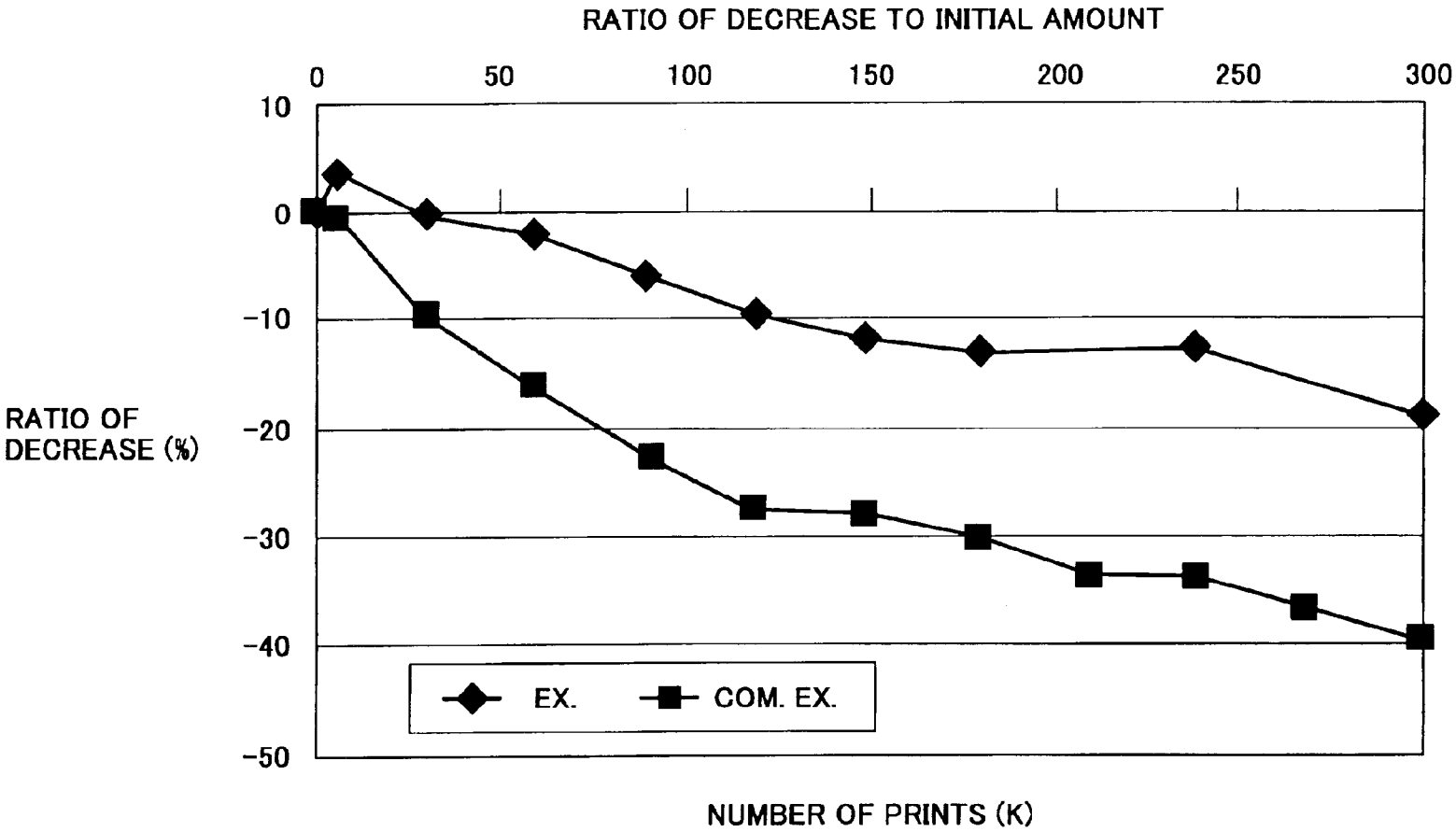
FIG. 19 is a graph showing how the amount of deposition decreases when carrier grains of Experiment 1 and 2 of the fourth embodiment are used.

FIG. 19 shows how the amount of deposition decreased from the initial amount of deposition during the running test. As shown, the amount of deposition of the carrier grains 1 of the illustrative embodiment varies less than the amount of deposition of the carrier grains 2; the ratio of decrease does not reach 20% even when 300,000 prints of size A4 were produced, which is a standard as the life of a developer. It was experimentally found that when the ratio of decrease exceeds 20%, defective images including a thin solid image and an image with brush marks occur. It follows that a ratio of decrease of 20% or below does not effect image quality. On the other hand, the carrier grains 2, which are the conventional carrier grains with a small grain size, decreased by 40% when 300,000 prints of size A4 were produced, resulting in the defective images.

It follows that with the carrier grains 1 it is not necessary to make the initial amount of deposition great. Therefore, when the gap Gp for development is reduced, there can be obviated the overflow of the developer, the locking of the developing roller, the adhesion of the developer to the sleeve and other troubles.

Experiment 2 pertaining to the volume resistivity of the magnetic carrier grains will be described hereinafter.

EXPERIMENT 2

Figure 20:
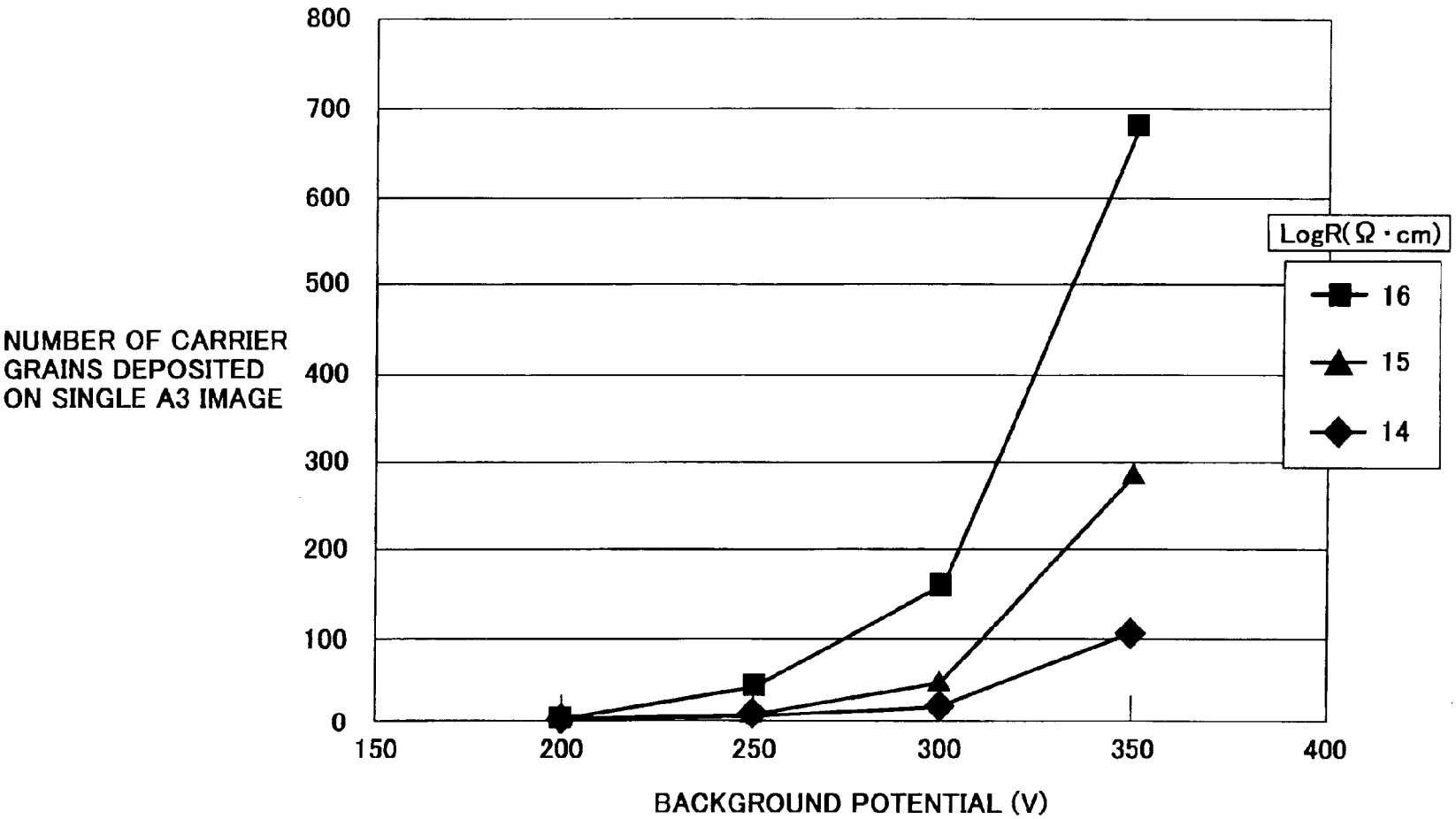
FIG. 20 is a graph showing how many carrier grains deposit on an image carrier with respect to different volume resistivity of the carrier grains in Experiment 2 of the fourth embodiment.

The carrier grains 1 were used except that their volume resistivity was varied to $10^{14}$ Ω·m, $10^{15}$ Ω·cm and $10^{16}$ Ω·cm. FIG. 20 shows a relation between the volume resistivity of 14, 15 and 16 (Log R(Ω·cm)) and the number of carrier grains deposited on the edge portions of a two-dot vertical line image and rendered them blank. For estimation, in the same image forming apparatus as one used in Experiment 1, the bias for image transfer was turned off while the background potential was varied to effect acceleration estimation. As FIG. 20 indicates, when the volume resistivity was the order of $10^{16}$ Ω·cm, the carrier deposition was noticeable. It will be seen that when the volume resistivity was sequentially lowered to $10^{15}$ Ω·cm and $10^{14}$ Ω·cm, the carrier deposition was remarkably improved.

Hereinafter will be described Experiment 3 pertaining to the flux density of the main pole P1 of the magnet roller 7*a* in the normal direction and that of the pole P2 downstream of the main pole P1.

EXPERIMENT 3

Figure 22:
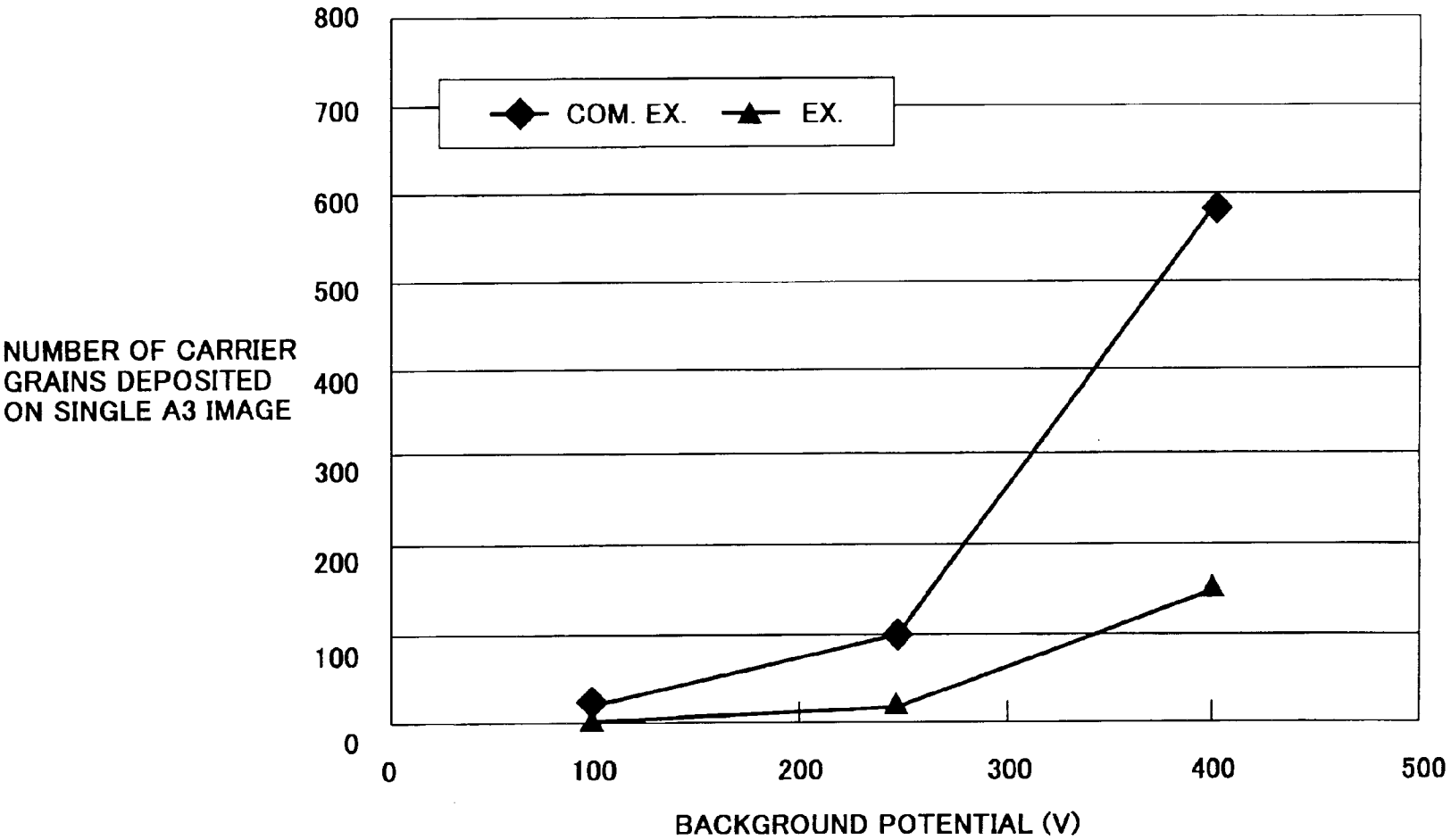
FIG. 22 is a graph showing how many carrier grains deposit on an image carrier with respect to different conditions of a magnet roller in the fourth embodiment.

Experiment 3 was also conducted with the carrier grains 1 and image forming apparatus used in Experiment 1 except that the flux density of the main pole P1 and that of the pole p2 downstream of the main pole P1 were varied as shown in FIG. 21. FIG. 22 shows the number of carrier gains deposited on the edge portions of a two-dot vertical line image and rendered them blank. Estimation was effected in the same manner as in Experiment 2. As FIG. 22 indicates, when the flux densities of the poles P1 and P2 are sequentially reduced to 115 mT and 85 mT, the carrier deposition is noticeably improved.

Experiment 4 to be described hereinafter pertains to the gap Gp for development between the sleeve 7 and the drum 8.

EXPERIMENT 4

Figure 23:
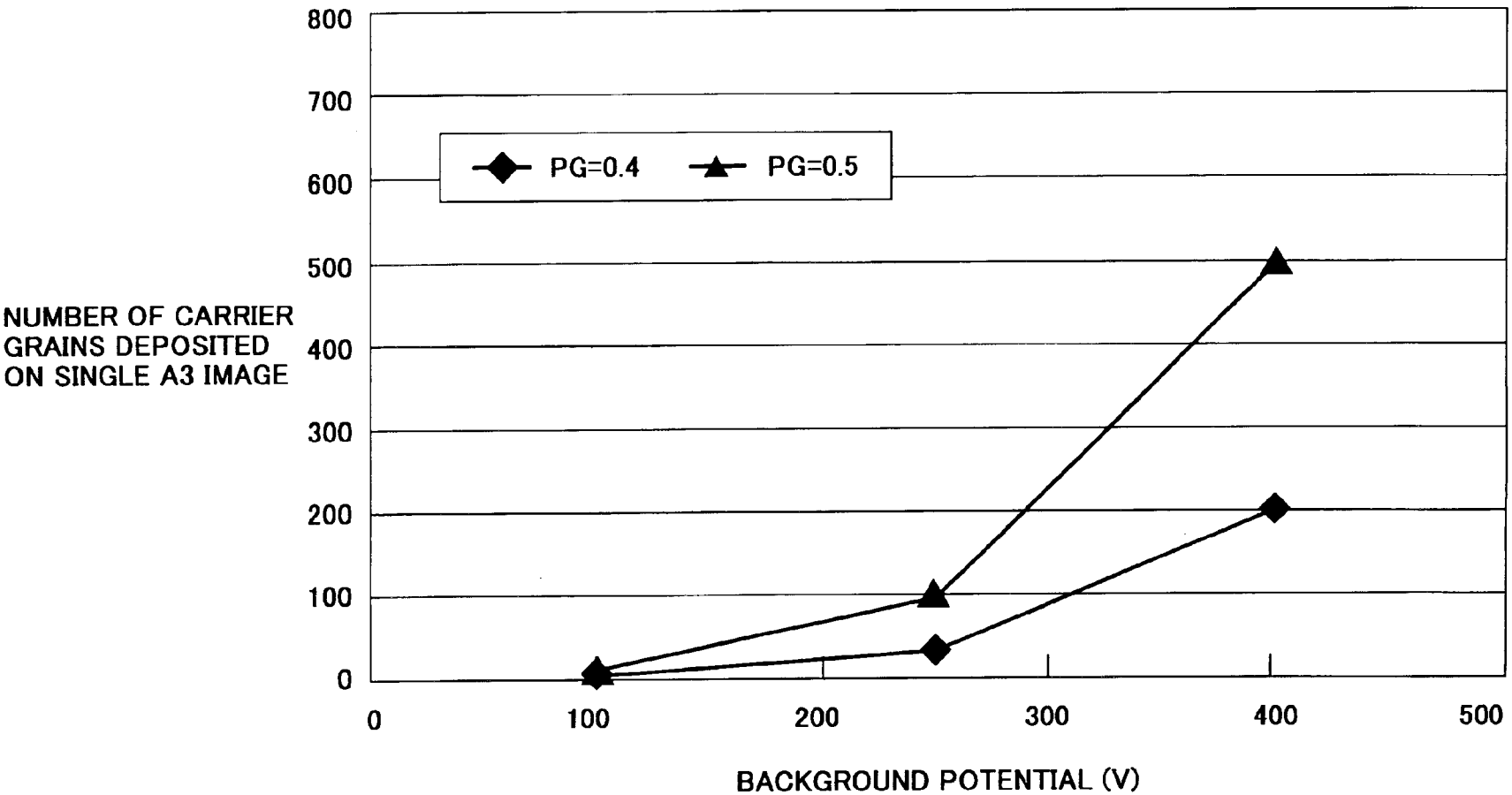
FIG. 23 is a graph showing how many carrier grains deposit on an image carrier with respect to different gaps for development in Experiment 4 in the fourth embodiment.

Experiment 4 was also conducted with the carrier grains 1 and image forming apparatus used in Experiment 1 except that only the gap Gp was varied to 0.4 mm and 0.5 mm. FIG. 23 shows the number of carrier grains deposited on the edge portions of a two-dot vertical line image and rendered them blank. Estimation was effected in the same manner as in Experiment 2. As FIG. 23 indicates, when the gap Gp is reduced to 0.4 mm, the carrier deposition is noticeably improved.

Experiment 5 pertaining to the bias for development will be described hereinafter.

EXPERIMENT 5

The carrier grains 1 were also used except that their volume resistivity was varied to $10^{14}$ Ω·cm, $10^{15}$ Ω·cm and $10^{16}$ Ω·cm. In the same image forming apparatus as one used in Experiment 1, only the bias for development was varied to DC and AC. FIG. 24 shows the results of estimation regarding a defective image ascribable to charge leak. It is to be noted that the DC bias was −500 V while the AC bias was −500 V on which a frequency of 5 kHz, a voltage Vpp (peak-to-peak) of 1.0 kV and a duty of 50% were superposed.

As shown in FIG. 24, when the volume resistivity was $10^{15}$ Ω·cm or below, the AC-biased DC caused defective images to occur due to charge leak. By contrast, the DC did not bring about any defective image even when the volume resistivity was lowered to $10^{15}$ Ω·cm and $10^{14}$ Ω·cm. Therefore, as Experiment 2 indicates, when the volume resistivity is lowered to reduce carrier deposition, AC cannot be superposed as a bias for development. On the other hand, a DC bias allows the volume resistivity to be lowered to $10^{14}$ Ω·cm, thereby reducing carrier deposition to a noticeable degree.

Figure 26:
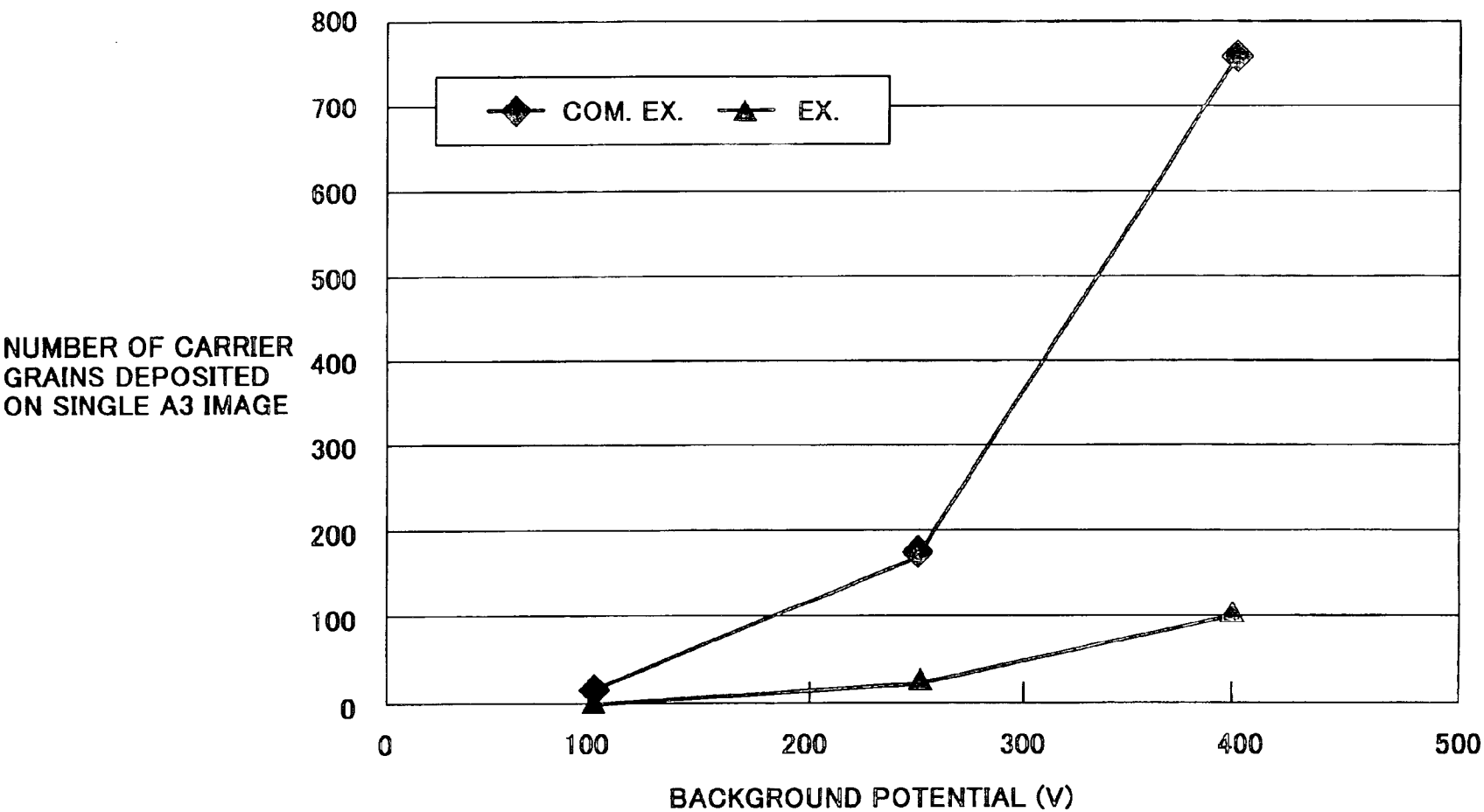
FIG. 26 is a graph showing how many carrier grains deposit on an image carrier in each of the fourth embodiment and Comparative Example.

FIG. 25 lists conditions that the illustrative embodiment selects for improving carrier deposition in light of the results of Experiments 1 through 5. FIG. 26 shows the number of carrier grains deposited on the edge portions of a two-dot vertical line image and rendered them blank, as determined in the conditions of FIG. 25. Estimation was effected in the same manner as in Example 2. As FIG. 26 indicates, in the conditions listed in FIG. 25, carrier deposition is improved to a level that does not matter at all as to image quality. Estimation effected in the conditions of FIG. 25 (conventional conditions) showed that carrier grains deposited to a critical degree.

As stated above, even with an image forming apparatus using magnetic carrier grains with a small grain size and a photoconductive drum and a sleeve having a small diameter each, the illustrative embodiment can reduce carrier deposition without bringing about charge leak and other side effects. It is therefore possible to insure high, stable image quality while reducing the overall size of the image forming apparatus.

Further, the magnetic carrier grains each are covered with a coating film containing binder resin and grains while the ratio D/h is lies in the range of $1<D/h<10$, as stated earlier. Such carrier grains are resistant to stress and therefore durable, reducing the deterioration of the developer. It follows that the amount of deposition of the developer on the sleeve decreases little due to the variation of the surface configuration of the individual carrier grain, making it unnecessary to make the initial amount of deposition great. Consequently, even when the gap Gp for development is reduced to reduce carrier deposition, there can be obviated the overflow of the developer, the locking of the developing roller, the adhesion of the developer to the sleeve and other troubles.

Various modifications will become possible for those skilled in the art after receiving the teachings of the present disclosure without departing from the scope thereof.

What is claimed is:

1. An image forming apparatus comprising:

a developing unit configured to develop a latent image formed on an image carrier with a developer carrier, the developing unit including, a rotatable, nonmagnetic sleeve, a magnetic unit configured to cause a two-ingredient type developer including magnetic carrier grains and toner grains to deposit on a surface of said developer carrier, the magnetic unit disposed in or circumscribed by said sleeve, and a rigid metering member configured to meter an amount of said developer deposited on said surface of said developer carrier, wherein the sleeve has a surface roughness Rz ranging from 5 $\mu$m to 20 $\mu$m, the carrier grains each are covered with a coating layer including at least binder resin and coating grains, a ratio of a diameter D of an individual coating grain included in said coating layer to a thickness h of a layer of the binder resin lies in a range of $1<D/h<10$, the carrier grains have a weight-mean grain size d ranging from 20 $\mu$m to 60 $\mu$m, and a shaft torque of the sleeve is between 0.5 kgf cm and 4.0 kgf cm.

2. An image forming apparatus comprising:

a developing unit configured to develop a latent image formed on an image carrier with a developer carrier, the developing unit including;

a rotatable, nonmagnetic sleeve, a magnetic unit configured to cause a two-ingredient type developer having magnetic carrier grains and toner grains to deposit on a surface of said developer carrier, the magnetic unit disposed in or circumscribed by said sleeve, and a rigid metering member configured to meter an amount of said developer deposited on said surface of said developer carrier, wherein a shaft torque of the sleeve is between 0.5 kgf cm and 4.0 kgf cm, the carrier grains each are covered with a coating layer including at least binder resin and coating grains, and a ratio of a diameter D of an individual coating grain included in said coating layer to a thickness h of a layer of the binder resin lies in a range of $1<D/h<10$.

3. The apparatus as claimed in claim 2, wherein the metering member is formed of a magnetic material.

4. The apparatus as claimed in claim 2, wherein the magnetic unit includes a magnetic pole facing said metering member and having a flux density of 45 mT or above in a normal direction.

5. The apparatus as claimed in claim 2, wherein the toner grains contain wax each.

6. An image forming method using a developing unit configured to develop a latent image formed on an image carrier with a developer carrier, the developing unit including, a rotatable, nonmagnetic sleeve, a magnetic unit configured to cause a two-ingredient type developer including magnetic carrier grains and toner grains to deposit on a surface of said developer carrier, the magnetic unit disposed in or circumscribed by said sleeve, and a rigid metering member configured to meter an amount of said developer deposited on said surface of said developer carrier, wherein a shaft torque of the sleeve is between 0.5 kgf cm and 4.0 kgf cm, the carrier coating grains each are covered with a coating layer including at least binder resin and grains, and a ratio of a diameter D of an individual coating grain included in said coating layer to a thickness h of a layer of the binder resin lies in a range of $1<D/h<10$.

7. The method as claimed in claim 6, wherein the metering member is formed of a magnetic material.

8. The apparatus as claimed in claim 6, wherein the magnetic unit includes a magnetic pole facing said metering member and having a flux density of 45 mT or above in a normal direction.

9. The apparatus as claimed in claim 6, wherein the toner grains contain wax each.

10. An image forming apparatus comprising:

a developing unit configured to develop a latent image formed on an image carrier with a developer carrier, the developing unit including, a rotatable, nonmagnetic sleeve, a magnetic unit configured to cause a two-ingredient type developer including magnetic carrier grains and toner grains to deposit on a surface of said developer carrier, for thereby producing a toner image corresponding to a latent image formed on said surface of said developer carrier, wherein said developer carrier and said image carrier respectively have a diameter of 30 mm or below and 60 mm or below, the carrier grains have a weight-mean grain size ranging from 20 $\mu$m to 40 $\mu$m and a volume resistivity of $10^{15}$ Ωcm or below, the magnetic unit includes a main magnetic pole facing the image carrier and having a flux density of 115 mT or above in a normal direction and a magnetic pole positioned downstream of said main pole in a direction of rotation of the developer carrier and having a flux density of 85 mT or above, a gap between the developer carrier and the image carrier is 0.4 mm or below, and a bias for development applied to the developer carrier is a DC bias.

11. The apparatus as claimed in claim 10, wherein the carrier grains each are covered with a coating layer containing at least binder resin and coating grains having a coating grain size D each, and a ratio of the coating grain size D to a thickness h of a layer of the binder resin lies in a range of $1<D/h<10$.

12. An image forming method for producing a latent image with a developing unit configured to develop a latent image formed on an image carrier with a developer carrier, the developing unit including, a rotatable, nonmagnetic sleeve, a magnetic unit configured to cause a two-ingredient type developer having magnetic carrier grains and toner grains to deposit on a surface of said developer carrier, for thereby producing a toner image corresponding to a latent image formed on said surface of said developer carrier, wherein said developer carrier and said image carrier respectively have a diameter of 30 mm or below and 60 mm or below, the carrier grains have a weight-mean grain size ranging from 20 $\mu$m to 40 $\mu$m and a volume resistivity of $10^{15}$ Ωcm or below, the magnetic unit includes a main magnetic pole facing the image carrier and having a flux density of 115 mT or above in a normal direction and a magnetic pole positioned downstream of said main pole in a direction of rotation of the developer carrier and having a flux density of 85 mT or above, a gap between the developer carrier and the image carrier is 0.4 mm or below, and a bias for development applied to the developer carrier is a DC bias.

13. The method as claimed in claim 12, wherein the carrier grains each are covered with a coating layer containing at least binder resin and coating grains having a coating grain size D each, and a ratio of the coating grain size D of said coating grains contained in said coating layer to a thickness h of a layer of the binder resin lies in a range of $1<D/h<10$.

* * * * *